US010701494B2

(12) United States Patent
Jensen et al.

(10) Patent No.: US 10,701,494 B2
(45) Date of Patent: Jun. 30, 2020

(54) HEARING DEVICE COMPRISING A SPEECH INTELLIGIBILITY ESTIMATOR FOR INFLUENCING A PROCESSING ALGORITHM

(71) Applicant: Oticon A/S, Smørum (DK)

(72) Inventors: Jesper Jensen, Smørum (DK); Michael Syskind Pedersen, Smørum (DK); Adel Zahedi, Smørum (DK)

(73) Assignee: OTICON A/S, Smørum (DK)

( * ) Notice: Subject to any disclaimer, the term of this patent is extended or adjusted under 35 U.S.C. 154(b) by 17 days.

(21) Appl. No.: 16/156,723

(22) Filed: Oct. 10, 2018

(65) Prior Publication Data

US 2019/0110135 A1 Apr. 11, 2019

(30) Foreign Application Priority Data

Oct. 10, 2017 (EP) ..... 17195685

(51) Int. Cl.
*H04R 25/00* (2006.01)

(52) U.S. Cl.
CPC ..... *H04R 25/505* (2013.01); *H04R 25/407* (2013.01); *H04R 2225/43* (2013.01)

(58) Field of Classification Search
CPC .. H04R 25/505; H04R 25/407; H04R 25/502; H04R 2225/43
See application file for complete search history.

(56) References Cited

U.S. PATENT DOCUMENTS

2005/0141737 A1 6/2005 Hansen
2015/0281857 A1* 10/2015 Hau ..... H04R 25/353 381/317

(Continued)

FOREIGN PATENT DOCUMENTS

EP 2 701 145 A1 2/2014
EP 3 057 335 A1 8/2016

(Continued)

*Primary Examiner* — Brian Ensey
(74) *Attorney, Agent, or Firm* — Birch, Stewart, Kolasch & Birch, LLP

(57) ABSTRACT

The application relates to a hearing device, e.g. a hearing aid, adapted for being worn by a user and for receiving sound from the environment of the user to process the sound with a view to the user's intelligibility of speech in said sound, wherein an estimate of the user's intelligibility of speech in said sound being defined by a speech intelligibility measure I of said sound at a current point in time t, the hearing device comprising a) an input unit for providing a number of electric input signals y, each representing said sound in the environment of the user, b) a signal processor for processing said number of electric input signals y according to a configurable parameter setting Θ of one or more processing algorithms, which when applied to said number of electric input signals y provides a processed signal $y_p(\Theta)$ in dependence thereof, the signal processor being configured to provide a resulting signal $y_{res}$, c) a controller configured to control the processor to provide said resulting signal $y_{res}$ at a current point in time t in dependence of c1) a parameter set Φ defining a hearing profile of the user, c2) said electric input signal(s) y or characteristics extracted from said electric input signal(s), e.g. a noise covariance matrix $C_v$ and/or covariance matrix $C_Y$ of noisy signals, c3) a current value I(y) of said speech intelligibility measure I for at least one of said electric input signals y, c4) a desired value Ides of said speech intelligibility measure, c5) a first parameter setting Θ1 of said one or more processing algorithms, c6) a current value $I(y_p(\Theta 1))$ of said speech intelligibility measure I for a first processed signal $y_p(\Theta 1)$ based on said first parameter setting Θ1, and c7) a second parameter setting Θ' of said one or more processing algorithms, which, when applied to said number of electric input signals y, provides a second processed signal $y_p(\Theta')$ exhibiting said desired value $I_{des}$ of said speech intelligibil- (Continued)

ity measure. The application further relates to a method of operating a hearing device. The invention may e.g. be used in hearing aid systems, or other portable audio processing systems.

23 Claims, 10 Drawing Sheets

(56) References Cited

U.S. PATENT DOCUMENTS

| | | | | |
|---|---|---|---|---|
| 2017/0295437 | A1 | 10/2017 | Bertelsen et al. | |
| 2019/0019526 | A1* | 1/2019 | Sorensen | G10L 21/0205 |

FOREIGN PATENT DOCUMENTS

| | | | |
|---|---|---|---|
| EP | 3 214 620 | A1 | 9/2017 |
| EP | 3 220 661 | A1 | 9/2017 |
| WO | WO 2014/094865 | A1 | 6/2014 |

* cited by examiner

A controller (CONT) configured to provide a resulting signal $y_{res}(t)$ in dependence of a speech intelligibility measure I(t)

HEARING DEVICE COMPRISING A SPEECH INTELLIGIBILITY ESTIMATOR FOR INFLUENCING A PROCESSING ALGORITHM

The present application relates to hearing devices, e.g. hearing aids, in particular to the processing of an electric signal representing sound according to a user's needs. A main task of a hearing aid is to increase a hearing impaired user's intelligibility of speech content in a sound field surrounding the user in a given situation. This goal is pursued by applying a number of processing algorithms to one or more electric input signals (e.g. delivered by one or more microphones). Examples of such processing algorithms are algorithms for compressive amplification, noise reduction (including spatial filtering (beamforming)), feedback reduction, de-reverberation, etc. Embodiments of the present disclosure are relevant for normally hearing persons, e.g. for augmenting hearing in difficult listening situations.

SUMMARY

In an aspect, the present disclosure deals with optimization of processing of electric input signal(s) from one or more sensors (e.g. sound input transducers, e.g. microphones, and optionally, additionally other types of sensors) with respect to a user's intelligibility of speech content, when the electric input signal(s) have been subject to such processing (e.g. after application of one or more specific processing algorithms to the electric input signal(s)). The optimization with respect to speech intelligibility considers a) the user's hearing ability (e.g. impairment) in interplay with b) the specific processing algorithms, e.g. noise reduction, including beamforming, to which the electric input signal(s) are subject before being presented to the user, and c) an acceptable goal for the user's speech intelligibility (SI, e.g. an SI-measure, e.g. reflecting an estimate of a percentage of words being understood).

The 'electric input signals from one or more sensors' may in general originate from identical types of sensors (e.g. sound sensors), or from a combination of different types of sensors, e.g. sound sensors, image sensors, etc. Typically, the 'one more sensors' comprise at least one sound sensor, e.g. a sound input transducer, e.g. a microphone.

A Hearing Device, e.g. a Hearing Aid:

In an aspect the present application provides a hearing device, e.g. a hearing aid, adapted for being worn by a user and for receiving sound from the environment of the user and to improve (or process the sound with a view to or in dependence of) the user's intelligibility of speech in said sound, an estimate of the user's intelligibility of speech in said sound being defined by a speech intelligibility measure I of said sound at a current point in time t. The hearing device comprises a) an input unit for providing a number of electric input signals y, each representing said sound in the environment of the user; and b) a signal processor for processing said number of electric input signals y according to a configurable parameter setting $\Theta$ of one or more processing algorithms, which when applied to said number of electric input signals y provides a processed signal $y_p(\Theta)$ in dependence thereof, the signal processor being configured to provide a resulting signal $y_{res}$. The hearing device may further comprise, c) a controller configured to control the processor to provide said resulting signal $y_{res}$ at a current point in time t in dependence of (at least one of)

a parameter set $\Phi$ defining a hearing profile of the user, said electric input signal(s) y, or characteristics extracted from said electric input signal(s), a current value I(y) of said speech intelligibility measure I for at least one of said electric input signals y, a desired value $I_{des}$ of said speech intelligibility measure, a first parameter setting $\Theta 1$ of said one or more processing algorithms, a current value $I(y_p(\Theta 1))$ of said speech intelligibility measure I for a first processed signal $y_p(\Theta 1)$ based on said first parameter setting $\Theta 1$, and a second parameter setting $\Theta'$ of said one or more processing algorithms, which, when applied to said number of electric input signals y, provides a second processed signal $y_p(\Theta')$ exhibiting said desired value $I_{des}$ of said speech intelligibility measure.

Thereby an improved hearing device may be provided.

In case—at a given point in time t—a current value I(y) of the speech intelligibility measure I for at least one of the (unprocessed) electric input signals y is larger than the desired value $I_{des}$ of the speech intelligibility measure, one or more actions may be taken (e.g. controlled by the controller). An action may e.g. be to skip (bypass) the processing algorithm(s) in question and provide the resulting signal $y_{res}(t)$ as the at least one electric input signals y(t) exhibiting $I(y(t))>I_{des}$.

The term 'characteristics extracted from said electric input signal(s)' is in the present context taken to include one or more parameters extracted from the electric input signal(s), e.g. a noise covariance matrix $C_v$ and/or a covariance matrix $C_Y$ of noisy signals y, parameter(s) related to modulation, e.g. a modulation index, etc. The noise covariance matrix $C_v$ may be predetermined in advance of use of the hearing device, or determined during use (e.g. adaptively updated). The speech intelligibility measure may be based on a predefined relationship of function, e.g. be a function of a signal to noise ratio of the input signal(s).

The controller may be configured to control the processor to provide that the resulting signal $y_{res}$ at a current point in time t is equal to a selectable signal $y_{sel}$, in case the current values I(y) and $I(y_p(\Theta 1))$ of the speech intelligibility measure I for the number of electric input signals y and the first processed signal $y_p(\Theta 1)$, respectively, are both smaller than said desired value $I_{des}$.

In an embodiment, the controller is configured to control the processor to provide that the resulting signal $y_{res}$ at a current point in time t is equal to said first processed signal $y_p(\Theta 1)$ based on said first parameter setting $\Theta 1$, in case the current value $I(y_p(\Theta 1))$ of the speech intelligibility measure I for the first processed signal $y_p(\Theta 1)$ is smaller than or equal to the desired value $I_{des}$ of the speech intelligibility measure. In other words, the selectable signal $y_{sel}$ is equal to the first processed signal $y_p(\Theta 1)$ (e.g. providing a maximum (but not optimal) SNR of the estimated target signal). In an embodiment, the selectable signal $y_{sel}$ is equal to one of the electric input signals y, e.g. an attenuated version, e.g. comprising an indication that the input signal is presently below normal standard. In an embodiment, the signal is chosen in dependence of a first threshold value $I_{th}$ of the speech intelligibility measure I, where $I_{th}$ is smaller than $I_{des}$. In an embodiment, $y_{sel}=y_p(\Theta 1)$ when $I_{th}<I(y_p(\Theta 1))<I_{des}$. In an embodiment, the selectable signal $y_{sel}$ is equal to or contains an information signal $y_{inf}$ indicating that the current input signal(s) is(are) too noisy to provide an acceptable speech intelligibility of the target signal. In an embodiment, $y_{sel}=y_{inf}$ (or $y_{sel}=y_{inf}+y_p(\Theta 1)*G$, where G is a gain factor, e.g. $0\leq G\leq 1$, or $G<1$), when $I(y_p(\Theta 1))<I_{th}$.

The controller may be configured to control the processor to provide that the resulting signal $y_{res}$ at a current point in time t is equal to the second, optimized, processed signal $y_p(\Theta')$ exhibiting the desired value $I_{des}$ of the speech intelligibility measure, in case the current value $I(y_p(\Theta 1))$ of the speech intelligibility measure I for the first processed signal $y_p(\Theta 1)$ is larger than the desired value $I_{des}$ of the speech intelligibility measure. In this case the processing parameter setting is modified (from Θ1 to Θ') to provide a reduced speech intelligibility measure ($I_{des}$) compared to the speech intelligibility measure $I(y_p(\Theta 1))$ of the first parameter setting (Θ1).

In an embodiment, the controller is configured to provide that the resulting signal $y_{res}$ is equal to the second processed signal $y_p(\Theta')$ in case A) I(y) is smaller than the desired value $I_{des}$, and B) $I(y_p(\Theta 1))$ is larger than the desired value $I_{des}$ of the speech intelligibility measure I. In an embodiment, the controller is configured to determine the second parameter setting Θ' under the constraint that the second processed signal $y_p(\Theta')$ exhibits the desired value $I_{des}$, of the speech intelligibility measure.

In an embodiment, the first parameter setting Θ1 is a default setting. The first parameter setting Θ1 may be a setting that maximizes a signal to noise ratio (SNR) or the speech intelligibility measure I of the first processed signal $y_p(\Theta 1)$. In an embodiment, the second (optimized) parameter setting Θ' is used by the one or more processing algorithms to process the number of electric input signal(s), and to provide a second (optimized) processed signal $y_p(\Theta')$ (yielding the desired level of speech intelligibility to the user, as reflected in the desired value $I_{des}$ of the speech intelligibility measure). The SNR may preferably be determined in a time-frequency framework, e.g. per TF-unit, cf. e.g. FIG. 3B). In an embodiment, the speech intelligibility measure I is a monotonous function of the signal to noise ratio. In an embodiment, the speech intelligibility measure I is determined in a scheme, where bands have increasing width with increasing frequency, e.g. according to a logarithmic scheme, e.g. in the form of one-third octave bands, or using an erb scale (approximating bandwidths of the human auditory system).

The one or more processing algorithms may comprise a single channel noise reduction algorithm. The single channel noise reduction algorithm may be configured to receive a single electric signal (e.g. a signal from a (possibly omnidirectional) microphone, or a spatially filtered signal (e.g. from a beamformer filtering unit)).

The input unit may be configured to provide a multitude of electric input signals $y_i$, i=1, . . . , M, each representing said sound in the environment of the user, and where the one or more processing algorithms comprises a beamformer algorithm for receiving said multitude of electric input signals, or processed versions thereof, and providing a spatially filtered, beamformed, signal, the beamformer algorithm being controlled by beamformer settings, and where said first parameter setting Θ1 of said one or more processing algorithms comprise a first beamformer setting, and where said second parameter setting Θ' of said one or more processing algorithms comprises a second beamformer setting.

The first beamformer settings are e.g. determined based on the multitude of electric input signals and one or more control signals, e.g. from one or more sensors (e.g. including a voice activity detector), without specifically considering a value of the speech intelligibility measure of the current beamformed signal. The first parameter setting Θ1 may constitute or comprise a beamformer setting that maximizes a (target) signal to noise ratio (SNR) of the (first) beamformed signal.

In an embodiment, the hearing device comprises a memory, wherein the desired value $I_{des}$ of said speech intelligibility measure is stored. In an embodiment, the desired value $I_{des}$ of said speech intelligibility measure is an average value (e.g. averaged over a large number of persons (e.g. >10)), e.g. empirically determined, or an estimated value. The desired speech intelligibility value $I_{des}$ may be specifically determined or selected for the user of the hearing device. The desired value $I_{des}$ of the speech intelligibility measure may be a user specific value, e.g. predetermined, e.g. measured or estimated in advance of the use of the hearing device. In an embodiment, the hearing device comprises a memory, wherein a desired speech intelligibility value (e.g. a percentage of intelligible words, e.g. 95%) $I_{des}$ for the user is stored.

In an embodiment, the controller is configured to aim at determining the second optimized parameter setting Θ' to provide said desired speech intelligibility value $I_{des}$ of said speech intelligibility measure for the user. The term 'aim at' is intended to indicate that such desired speech intelligibility value $I_{des}$ may not always be achievable (e.g. due to one or more of poor listening conditions (e.g. low SNR), insufficient available gain in the hearing device, feedback howl, etc.

The input unit may be configured to provide the number of electric input signals in a time-frequency representation $Y_r(k',m)$, r=1, . . . , M, where M is the number of electric input signals, k' is frequency index, and m is a time index. In an embodiment, the input unit comprises a number of input transducers, e.g. microphones, each providing one of the electric input signals $y_r(n)$, where n represents time. In an embodiment, the input unit comprises a number of time to time-frequency conversion units, e.g. analysis filter banks, e.g. short-time Fourier transform (STFT) units, for converting a time-domain electric input signal $y_r(n)$ to a time-frequency domain (sub-band) electric input signal $y_r(k',m)$. In an embodiment, the number of electric input signals is one. In an embodiment, the number of electric input signals is larger than or equal to two, e.g. larger than or equal to three or four.

The hearing device, e.g. the controller, may be configured to receive further electric input signals from a number of sensors, and to influence the control of the processor in dependence thereof. In an embodiment, the number of sensors comprises one or more of an external sound sensor, an image sensor, e.g. a camera (e.g. directed to the face (mouth) of a current target speaker, e.g. for providing alternative (SNR-independent) information about the target signal, e.g. for voice activity detection), a brain wave sensor (e.g. for identifying a sound source of current interest to the user), a movement sensor (e.g. a head tracker for providing head orientation for indication of direction of arrival (DoA) of a target signal), an EOG-sensor (e.g. for identifying DoA of a target signal, or indicating most probable DoAs). In an embodiment, the controller is configured give a higher weight to inputs from sensors, e.g. image sensors, the smaller the current apparent SNR or estimate of speech intelligibility is. Lip reading (e.g. based on an image sensor) may e.g. be increasingly relied on in difficult acoustic situations.

The controller is configured to provide that the speech intelligibility measure Ayres) of the resulting signal $y_{res}$ is smaller than or equal to the desired value $I_{des}$, unless a value of the speech intelligibility measure I(y) of one or more of the number of electric input signal(s) is larger than the desired value $I_{des}$. In the latter case, the controller is configured to maintain such speech intelligibility measure I(y) without trying to further improve it by applying said one or more processing algorithms. In such case, the controller is configured to bypass the one or more processing algorithms, and to provide one of the input signals y exhibiting $I(y)>I_{des}$, as the resulting signal $y_{res}$. In such case, the resulting signal is thus unprocessed by the one or more processing algorithms in question (but possibly processed by one or more other processing algorithms).

In an embodiment, the speech intelligibility measure I is a measure of a target signal to noise ratio, where the target signal represents a signal containing speech that the user currently intends to listen to, and the noise represents all other sound components in said sound in the environment of the user.

The hearing device may be adapted to a users' hearing profile, e.g. to compensate for a hearing impairment of the user. The hearing profile of the user may be defined by a parameter set Φ. The parameter set Φ may e.g. define the user's (frequency dependent) hearing thresholds (or their deviation from normal; e.g. reflected in an audiogram). In an embodiment, one of the 'one or more processing algorithms', is configured to compensate for a hearing loss of the user. In an embodiment, a compressive amplification algorithm (for adapting the input signal(s) to a user's needs) forms part of the 'one or more processing algorithms'.

The controller may be configured to determine the estimate of the speech intelligibility measure I for use in determining the second, optimized, parameter setting Θ'(k',m) with a second frequency resolution k that is lower than a first frequency resolution k' that is used to determine the first parameter setting Θ1(k',m) on which the first processed signal $Y_p(\Theta 1)$ is based. In an embodiment, a first part of the processing (e.g. the processing of the electric input signals using first processing settings Θ1(k',m)) is applied in individual frequency bands with a first frequency resolution, represented by a first frequency index k', and a second part of the processing (e.g. the determination of the speech intelligibility measure I(k,m,Θ,Φ) of the processed signal for use in modifying the first parameter settings Θ1(k',m) to optimized parameter settings Θ'(k',m)) is applied in individual frequency bands with a second (different, e.g. lower) frequency resolution, represented by a second frequency index k (see e.g. FIG. 3B).

In an embodiment, the hearing device constitutes or comprises a hearing aid.

In an embodiment, the hearing device, e.g. a signal processor, is adapted to provide a frequency dependent gain and/or a level dependent compression and/or a transposition (with or without frequency compression) of one or more frequency ranges to one or more other frequency ranges, e.g. to compensate for a hearing impairment of a user.

In an embodiment, the hearing device comprises an output unit for providing a stimulus perceived by the user as an acoustic signal based on the processed electric input signal. In an embodiment, the output unit comprises a number of electrodes of a cochlear implant or a vibrator of a bone conducting hearing aid. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing aid).

The hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound.

In an embodiment, the hearing device comprises a directional microphone system adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art. In hearing aids, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

In an embodiment, the hearing device comprises an antenna and transceiver circuitry (e.g. a wireless receiver) for wirelessly receiving a direct electric input signal from another device, e.g. from an entertainment device (e.g. a TV-set), a communication device, a wireless microphone, or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by antenna and transceiver circuitry of the hearing device can be of any type. In an embodiment, the wireless link is established between two devices, e.g. between an entertainment device (e.g. a TV) and the hearing device, or between two hearing devices, e.g. via a third, intermediate device (e.g. a processing device, such as a remote control device, a smartphone, etc.). In an embodiment, the wireless link is used under power constraints, e.g. in that the hearing device is or comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. Preferably, communication between the hearing device and other devices is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing aid is a portable device, e.g. a device comprising a local energy source, e.g. a battery, e.g. a rechargeable battery, e.g. a hearing aid.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at ti, by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing device comprise an analogue-to-digital (AD) converter to digitize an analogue input (e.g. from an input transducer, such as a microphone) with a predefined sampling rate, e.g. 20 kHz. In an embodiment, the hearing device comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

In an embodiment, the hearing device comprises a language detector for estimating the current language or is configured to receive such information from another device, e.g. from a remote control device, e.g. from a smartphone, or similar device. An estimated speech intelligibility may depend on whether the used language is the listener's native language or a second language. Consequently, the amount of noise reduction needed may depend on the language.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device comprises an acoustic (and/or mechanical) feedback suppression system. In an embodiment, the hearing device further comprises other relevant functionality for the application in question, e.g. compression, noise reduction, etc.

In an embodiment, the hearing device is or comprises a hearing aid. In an embodiment, the hearing aid is or comprises a hearing instrument, e.g. a hearing instrument adapted for being located at the ear or fully or partially in the ear canal of a user, or for being fully or partially implanted in the head of a user. In an embodiment, the hearing device is or comprises a headset, an earphone, or an active ear protection device.

In a further aspect, a hearing device, e.g. a hearing aid, adapted for being worn by a user and for receiving sound from the environment of the user and to improve (or process the sound with a view to) the user's intelligibility of speech in said sound is provided by the present disclosure. An estimate of the user's intelligibility of speech in said sound being defined by a speech intelligibility measure I of said sound at a current point in time t. The hearing device comprises An input unit for providing a number of electric input signals y, each representing said sound in the environment of the user;

A signal processor for processing said number of electric input signals y according to a configurable parameter setting $\Theta$ of one or more processing algorithms, which when applied to said number of electric input signals y provides a processed signal $y_p(\Theta)$ in dependence thereof, the signal processor being configured to provide a resulting signal $y_{res}$;

A memory wherein a desired value $I_{des}$ of said speech intelligibility measure is stored; and A controller configured to control the processor to provide said resulting signal $y_{res}$ at a current point in time t according to the following scheme In case that a current value I(y) of said speech intelligibility measure I for said number of electric input signals y is smaller than the desired value $I_{des}$, and that a current value $I(y_p(\Theta 1))$ of a first processed signal $y_p(\Theta 1)$ for a first parameter setting $\Theta 1$ of said one or more processing algorithms is larger than the desired value $I_{des}$ of the speech intelligibility measure I, Determining a second parameter setting $\Theta'$ under the constraint that the second processed signal $y_p(\Theta')$ exhibits the desired value $I_{des}$ of the speech intelligibility measure and setting said resulting signal $y_{res}$ equal to said second processed signal $y_p(\Theta')$.

It is intended that some or all of the structural features of the hearing device described above, in the 'detailed description of embodiments' or in the claims can be combined with embodiments of the hearing device according to the further aspect.

The number of electric input signals y may be one, or two, or more.

The controller may further be configured to control the processor to provide said resulting signal $y_{res}$ at a current point in time t according to the following scheme In case that a current value I(y) of said speech intelligibility measure I for said one of said electric input signals y is larger than or equal to said desired value $I_{des}$, setting said resulting signal $y_{res}$ equal to one of said electric input signals y; and In case that current values I(y) and $I(y_p(\Theta 1))$ of said speech intelligibility measure I for said number of electric input signals y and for a first processed signal $y_p(\Theta 1)$ for a first parameter setting $\Theta 1$ of said one or more processing algorithms, respectively, are both smaller than said desired value $I_{des}$, setting said resulting signal $y_{res}$ equal to a selectable signal $y_{sel}$.

The hearing device may be configured to provide that the first parameter setting $\Theta 1$ is a setting that maximizes a signal to noise ratio (SNR) or the speech intelligibility measure I of the first processed signal $y_p(\Theta 1)$.

In a still further aspect, a hearing device, e.g. a hearing aid, is provided. The hearing device comprises a processor for applying one or more processing algorithms to an electric input signal y representing sound, e.g. speech, a speech intelligibility estimator providing an estimate I of a user's intelligibility of said sound at a current time m from said electric input signal y (m), a predictor of a current value, e.g. a current time frame, of the electric input signal y(m) from previous values of the input signal y(m−1), . . . , y(m−N), e.g. N previous time frames, of the electric input signal, a controller configured to control the speech intelligibility estimator in dependence of the estimated predictability of the sound signal, to thereby provide a modified speech intelligibility estimate.

It is intended that some or all of the structural features of the hearing device described above, in the 'detailed description of embodiments' or in the claims can be combined with embodiments of the hearing device according to the still further aspect.

The controller may be configured to apply a higher weight to the speech intelligibility estimator the lower the estimated predictability of the sound signal, to thereby provide the modified speech intelligibility estimate.

The hearing device may be configured to control the one or more processing algorithms, e.g.

a beamformer-noise reduction algorithm, in dependence of the modified speech intelligibility estimate (see e.g. FIG. 7A, 7B).

Use:

In an aspect, use of a hearing aid as described above, in the 'detailed description of embodiments' and in the claims, is moreover provided. In an embodiment, use is provided in a system comprising one or more hearing aids (e.g. hearing instruments), or headsets, e.g. in handsfree telephone systems, teleconferencing systems, public address systems, karaoke systems, classroom amplification systems, etc.

A Method:

In an aspect, a method of operating a hearing device adapted for being worn by a user and to improve (or to process sound with a view to) the user's intelligibility of speech in sound is furthermore provided by the present application. The method comprises receiving sound comprising speech from the environment of the user;

providing a speech intelligibility measure I for estimating a user's ability to understand speech in said sound at a current point in time t;

providing a number of electric input signals, each representing said sound in the environment of the user;

processing said number of electric input signals according to a configurable parameter setting $\Theta$ of one or more processing algorithms, and providing a resulting signal $y_{res}$.

The method may further comprise controlling the processing by providing said resulting signal $y_{res}$ at a current point in time t in dependence of (at least one of)

a parameter set $\Phi$ defining a hearing profile of the user, said number of electric input signals y, or characteristics extracted from said electric input signal(s), a current value I(y) of said speech intelligibility measure I for at least one of said electric input signals y, a desired value $I_{des}$ of said speech intelligibility measure, and a first parameter setting $\Theta 1$ of said one or more processing algorithms, and a current value $I(y_p(\Theta 1))$ of said speech intelligibility measure I for a first processed signal $y_p(\Theta 1)$ based on said first parameter setting $\Theta 1$, and a second parameter setting $\Theta'$ of said one or more processing algorithms, which, when applied to said number of electric input signals y, provides a second processed signal $y_p(\Theta')$ exhibiting said desired value $I_{des}$ of said speech intelligibility measure.

In a further aspect, a method of operating a hearing device, e.g. a hearing aid, adapted for being worn by a user and for receiving sound from the environment of the user and to improve (or to process the sound with a view to) the user's intelligibility of speech in said sound is provided by the present disclosure. An estimate of the user's intelligibility of speech in said sound being defined by a speech intelligibility measure I of said sound at a current point in time t. The method comprises Providing a number of electric input signals y, each representing said sound in the environment of the user;

Processing said number of electric input signals y according to a configurable parameter setting $\Theta$ of one or more processing algorithms, which when applied to said number of electric input signals y provides a processed signal $y_p(\Theta)$ in dependence thereof, the signal processor being configured to provide a resulting signal $y_{res}$;

Storing a desired value $I_{des}$ of said speech intelligibility measure; and

Controlling the processing to provide said resulting signal $y_{res}$ at a current point in time t is provided according to the following scheme In case that a current value I(y) of said speech intelligibility measure I for said number of electric input signals y is smaller than the desired value $I_{des}$, and that a current value $I(y_p(\Theta 1))$ of a first processed signal $y_p(\Theta 1)$ for a first parameter setting $\Theta 1$ of said one or more processing algorithms is larger than the desired value $I_{des}$ of the speech intelligibility measure I, Determining a second parameter setting $\Theta'$ under the constraint that the second processed signal $y_p(\Theta')$ exhibits the desired value $I_{des}$ of the speech intelligibility measure and setting said resulting signal $y_{res}$ equal to said second processed signal $y_p(\Theta')$.

The number of electric input signals y may be one, or two, or more.

The method may further comprise controlling the processing to provide that said resulting signal $y_{res}$ at a current point in time t is provided according to the following scheme In case that a current value I(y) of said speech intelligibility measure I for said one of said electric input signals y is larger than or equal to said desired value $I_{des}$, setting said resulting signal $y_{res}$ equal to one of said electric input signals y; and In case that current values I(y) and $I(y_p(\Theta 1))$ of said speech intelligibility measure I for said number of electric input signals y and for a first processed signal $y_p(\Theta 1)$ for a first parameter setting $\Theta 1$ of said one or more processing algorithms, respectively, are both smaller than said desired value $I_{des}$, setting said resulting signal $y_{res}$ equal to a selectable signal $y_{sel}$.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

The method is repeated over time, e.g. according to a predefined scheme, e.g. periodically, e.g. every time instance m, e.g. for every time frame of a signal of the forward path. In an embodiment, the method is repeated every $N^{th}$ time frame, e.g. every N=10 time frames or every N=100 time frames. In an embodiment, N is adaptively determined in dependence of the electric input signal, and/or of one or more sensor signals (e.g. indicative of a current acoustic environment of the user, and/or of a mode of operation of the hearing device, e.g. a battery status indication).

In an embodiment, the first parameter setting $\Theta 1$ is a setting that maximizes a signal to noise ratio (SNR) and/or a said speech intelligibility measure I of the first processed signal $y_p(\Theta 1)$.

The method may comprise: providing the number of electric input signals y in a time frequency representation y(k',m), where k' and m are frequency and time indices, respectively.

The method may comprise: providing that the speech intelligibility measure I(t) comprises estimating an apparent SNR, SNR (k,m,$\Phi$), in each time frequency tile (k,m). The speech intelligibility measure I(t) may be a function $f(\bullet)$ of an SNR, e.g. on a time-frequency tile level. The function $f(\bullet)$ may be modeled by a neural network that maps SNR-estimates SNR(k,m) to predicted intelligibility I(k,m). In an embodiment, I=f(SNR(k,m,Φ,Θ)), e.g.:

$$I(m_0) = \frac{1}{M'}\frac{1}{K}\sum_{m=m_0-M'+1}^{m_0}\sum_{k=1}^{K}\frac{\widehat{SNR}(k, m, \Phi, \Theta)}{\widehat{SNR}(k, m, \Phi, \Theta)+1}$$

where $m_0$ represents a current point in time, and M' represents the number of time frames containing speech considered (e.g. corresponding to a recent syllable, or a word, or an entire sentence), and where $\widehat{SNR}$ is estimated from noisy electric input signals or processed versions thereof (using parameter setting Θ).

In an embodiment, the method comprises: providing that the resulting signal $y_{res}$ at a current point in time t comprises Setting $y_{res}$ equal to one of said electric input signals y in case that a current value I(y) of said speech intelligibility measure I for said one of said electric input signals y is larger than or equal to said desired value $I_{des}$; and in case that a current value I(y) of said speech intelligibility measure I for said electric input signals y is smaller than the desired value $I_{des}$, and that a current value $I(y_p(\Theta 1))$ of the first processed signal is larger than the desired value $I_{des}$ of the speech intelligibility measure I, Determining said second parameter setting Θ' under the constraint that the second processed signal $y_p(\Theta')$ exhibits the desired value $I_{des}$ of the speech intelligibility measure;

Setting $y_{res}$ equal to said second processed signal $y_p(\Theta')$.

The one or more processing algorithms may comprise a single channel noise reduction algorithm and/or a multi-input beamformer filtering algorithm. The number of electric input signals y may be larger than one, e.g. two or more. In an embodiment, the beamformer filtering algorithm comprises an MVDR algorithm.

The method may comprise that the second parameter setting Θ' is determined under a constraint of minimizing a change of said electric input signals y. In the event that the SNR of the electric input signal(s) (e.g. unprocessed inputs signals) corresponds to a speech intelligibility measure I that exceeds the desired speech intelligibility value $I_{des}$, the one or more processing algorithms should not be applied to the electric input signals. 'Minimizing a change of the inputs signals' may e.g. mean performing as little processing on the signals as possible. 'Minimizing a change of said number of electric input signals' may e.g. be evaluated using a distance measure, e.g. an Euclidian distance, e.g. applied to waveforms, e.g. in a time domain or a time-frequency representation.

The method may comprise that the apparent SNR is estimated following a maximum likelihood procedure.

The method may comprise that the second parameter setting Θ' is estimated with a first frequency resolution k' that is finer than a second frequency resolution k that is used to determine the estimate of speech intelligibility I.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing aid as described above, in the 'detailed description of embodiments', and in the claims, AND an auxiliary device is moreover provided.

In an embodiment, the hearing system is adapted to establish a communication link between the hearing aid and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing aid(s). In an embodiment, the function of a remote control is implemented in a SmartPhone, the SmartPhone possibly running an APP allowing to control the functionality of the audio processing device via the SmartPhone (the hearing aid(s) comprising an appropriate wireless interface to the SmartPhone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid.

In an embodiment, the auxiliary device is or comprises another hearing aid. In an embodiment, the hearing system comprises two hearing aids adapted to implement a binaural hearing system, e.g. a binaural hearing aid system.

In an embodiment, binaural noise reduction (comparing and coordinating noise reduction between the two hearing aids of the hearing system) is only enabled in the case where the monaural beamformers (the beamformers of the individual hearing aids) do not provide a sufficient amount of help (e.g. cannot provide a speech intelligibility measure equal to $I_{des}$). Hereby also the amount of transmitted data between the ears depend on the estimated speech intelligibility (and can thus be decreased).

An APP:

In a further aspect, a non-transitory application, termed an APP, is furthermore provided by the present disclosure. The APP comprises executable instructions configured to be executed on an auxiliary device to implement a user interface for a hearing aid or a hearing system described above in the 'detailed description of embodiments', and in the claims. In an embodiment, the APP is configured to run on cellular phone, e.g. a smartphone, or on another portable device allowing communication with said hearing aid or said hearing system.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearing aid systems, or other portable audio processing systems.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
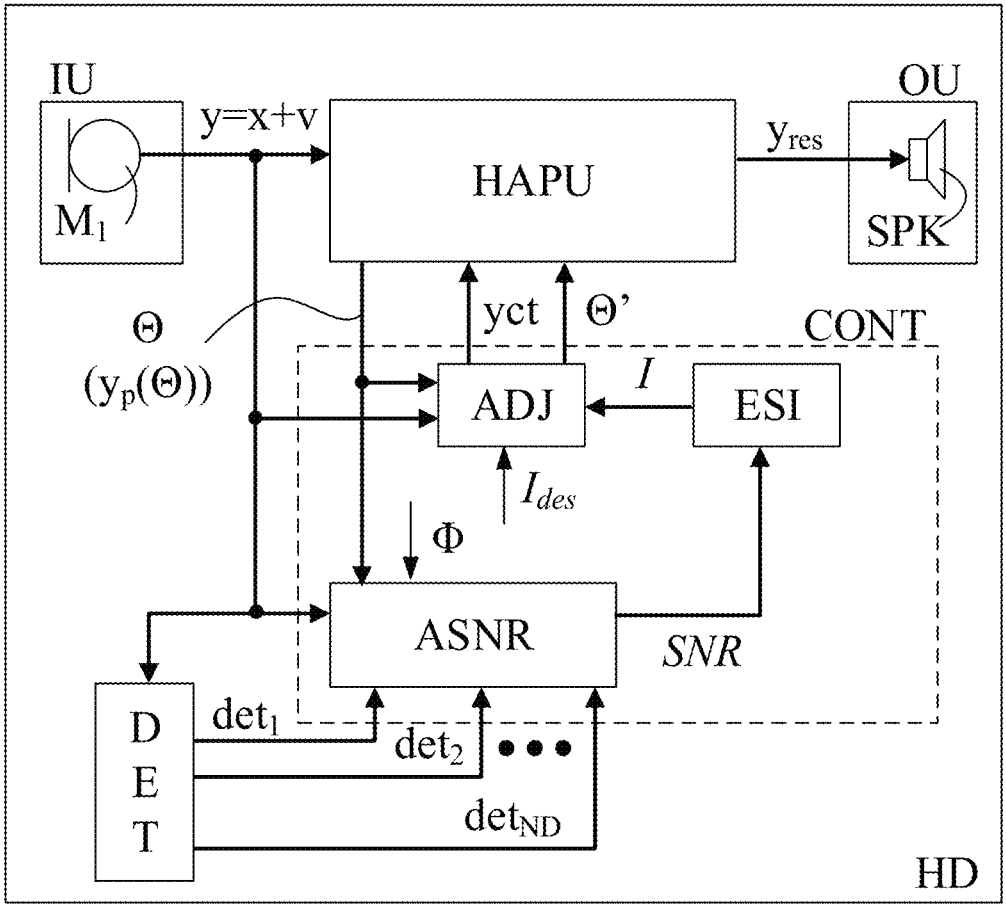
FIG. 1A shows an embodiment of a hearing aid according to the present disclosure comprising a single input transducer.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids. A main task of a hearing aid is to increase a hearing impaired user's intelligibility of speech content in a sound field surrounding the user in a given situation. This goal is pursued by applying a number of processing algorithms to one or more electric input signals (e.g. delivered by one or more microphones). Examples of such processing algorithms are algorithms for compressive amplification, noise reduction (including spatial filtering), feedback reduction, de-reverberation, etc.

EP3057335A1 deals with a binaural hearing system wherein processing of audio signals of respective left and right hearing devices is controlled in dependence of a (binaural) speech intelligibility measure of the processed signal. US20050141737A1 deals with a hearing aid comprising a speech optimization block adapted for selecting a gain vector representing levels of gain for respective frequency band signals, for calculating, based on the frequency band signals and the gain vector, a speech intelligibility index, and for optimizing the gain vector through iteratively varying the gain vector, calculating respective indices of speech intelligibility and selecting a vector that maximizes the speech intelligibility index. WO2014094865A1 deals with a method of optimizing a speech intelligibility measure by iteratively varying the applied gain in individual frequency bands of a hearing aid until a maximum is reached.

FIG. 1A shows an embodiment of a hearing aid according to the present disclosure comprising a single input transducer. FIG. 1A shows a hearing aid (HD) adapted for being worn by a user (e.g. at or in an ear, or for fully or partially being implanted in the head of a user). The hearing aid is adapted for receiving sound comprising speech from the environment of the user. The hearing aid may be adapted to a hearing profile of the user, e.g. configured to compensate for a hearing impairment of the user, to improve (or process the sound with a view to) the user's intelligibility of speech in the sound. The hearing profile of the user is e.g. defined by a parameter Φ (or a parameter set, e.g. comprising a number of parameters and/or data, e.g. representative of the hearing thresholds of the user, or an audiogram defining a user's frequency dependent hearing loss compared to a normal average). An estimate of the user's intelligibility of speech in the sound is e.g. defined by a speech intelligibility model, e.g. embodied in a speech intelligibility measure I(t), of the sound at a given (e.g. current) point in time t (e.g. the speech intelligibility index, as e.g. defined in American National Standards Institute (ANSI) standard ANSI/ASA S3.5-1997 (e.g. R2017) [5], or the STOI intelligibility measure [11].

The hearing aid (HD) comprises an input unit (IU) for providing a number (e.g. a multitude, here one) of electric input signals, y, each representing sound in the environment of the user. The hearing aid (HD) further comprises a configurable signal processor (HAPU) for processing the electric input signal(s) according to a configurable parameter setting Θ of one or more processing algorithms, and providing a resulting (preferably optimized, e.g. processed) signal $y_{res}$. The hearing aid (HD) comprises an output unit (OU) for providing stimuli representative of the (resulting) processed signal and perceivable as sound by the user. The input unit (IU), the signal processor (HAPU) and the output unit (OU) are operationally connected and form part of a forward path of the hearing aid. In the embodiment of FIG. 1A, the input unit (IU) comprises a single input (sound) transducer in the form of microphone $M_1$. The input unit may e.g. further comprise an analogue to digital converter for providing the electric input signal y as a stream of digital samples (e.g. with a sampling frequency $f_s$=20 kHz or more), and/or an analysis filter bank for providing the electric input signal y in a time-frequency representation Y(k',m), k' and m being frequency and time indices, respectively. The electric input signal y can without loss of generality be expressed as a sum of a target signal component (x) and a noise signal component (v). The electric input signal y (denoted y=x+v in FIG. 1A) is assumed (at least in certain time segments) to contain a target(speech) signal (here denoted x) mixed with other signals, termed noise (here denoted v). The (resulting), possibly processed, signal $y_{res}$ from the signal processor may e.g. represent an estimate of the current target signal, or certain parts of such signal (e.g. appropriately filtered, or amplified or attenuated to match a user's current needs) intended to be presented to the user. In the embodiment of FIG. 1A, the output unit (OU) comprises an output transducer, here a loudspeaker (SPK), for converting the resulting signal $y_{res}$ to an acoustic signal. The output unit (OU) may e.g. further comprise a synthesis filter bank for converting a time-frequency representation of the resulting signal $y_{res}$ from a number of sub-band signals to a single time-domain signal. The output unit (OU) may e.g. further comprise a digital to analogue converter for converting a stream of digital samples to an analogue signal.

The hearing aid (HD) further comprises a controller (CONT, cf. dashed outline in FIG. 1A) configured to control the processor providing the resulting signal $y_{res}$ (at a given point in time) in dependence of a multitude of inputs and predetermined criteria. The inputs comprise a) the speech intelligibility measure I(y) of the electric input signal(s) y, b) the speech intelligibility measure $I(y_p(\Theta 1))$ of a first processed signal $y_p(\Theta 1)$ based on a first parameter setting Θ1 of the one or more processing algorithms (e.g. a parameter setting Θ1 providing maximum intelligibility I and/or signal to noise ratio SNR on a time frequency unit level). The inputs further comprise c) a desired value $I_{des}$ of the speech intelligibility measure (e.g. stored in a memory, e.g. configurable via a user interface), d) a parameter set Φ indicative of a hearing profile of the user (e.g. reflecting a normal hearing or a hearing impairment). Subject to a predetermined criterion ($I(y)<I_{des}$, and $I(y_p(\Theta 1))>I_{des}$), the resulting signal $y_{res}$ (at a given point in time) is determined in dependence of e) a second (optimized) parameter setting Θ' of the one or more processing algorithms determined under the constraint that the speech intelligibility measure $I(y_p(\Theta'))$ of the second processed signal $y_p(\Theta')$ is equal to the desired value $I_{des}$. The hearing device, e.g. the controller, is configured to determine the second parameter setting Θ' under the constraint that the second processed signal $y_p(\Theta')$ exhibits the desired value $I_{des}$ of the speech intelligibility measure I. The second parameter setting Θ' may be determined by a variety of methods, e.g. an exhaustive search among the possible values, e.g. based on systematic changes of specific frequency bands known to have importance for speech intelligibility (e.g. using an iterative method), and/or optimizing with further constraints, or using specific properties of the speech intelligibility measure, e.g. its monotonous dependency of a signal to noise ratio, or using statistical methods, iteration, etc. In the embodiment of FIG. 1A, the controller (CONT) comprises an SNR estimation unit (ASNR) for estimating an apparent SNR, SNR(k',m,Φ), based on the (unprocessed) electric input signal(s) y, or based on the processed signal(s) $y_p$ using a specific parameter setting Θ of the one or more processing algorithms (as e.g. determined in subsequent steps, or in parallel, if two independent ASNR algorithms are at hand). The SNR estimation unit (ASNR) receives information about the user's hearing ability (hearing profile), e.g. hearing impairment, e.g. as reflected by an audiogram, cf. input parameter(s) D. The (unprocessed) electric input signal(s) y may be provided by the input unit (IU). The first processed signal $y_p(\Theta 1)$ based on the first parameter setting Θ1 may e.g. be provided by the signal processor and used as input to the SNR estimation unit (ASNR). In an embodiment, a second processed signal $y_p(\Theta')$ based on the second parameter setting Θ' is provided by the signal processor and used as input to the SNR estimation unit (ASNR) to check whether its speech intelligibility measure $I(y_p(\Theta'))$ fulfills the criterion of being substantially equal to $I_{des}$. The controller (CONT) further comprises a speech intelligibility estimator (ESI) for providing an estimate I of the user's intelligibility of the current electric input signals y, and the processed signals $y_p$, e.g. the first or second processed signals ($y_p(\Theta 1)$, $y_p(\Theta')$), based on the apparent SNR, SNR(k',m,Φ), SNR(k',m,Θ1,Φ) and SNR(k',m,Θ',Φ), respectively, of the respective input signals. The estimation of speech intelligibility is e.g. performed in a lower frequency resolution than the estimation of SNR and the parameter settings (Θ1, Θ'). The speech intelligibility estimator (ESI) may comprise an analysis filter bank (or a band sum unit for consolidating a number of frequency sub-bands K' to a smaller number K, see e.g. FIG. 3B) for providing the input signals in an appropriate number and size of frequency bands, e.g. distributing the frequency range into one-third octave bands. The controller (CONT) further comprises an adjustment unit (ADJ) for providing a control signal yct for controlling the resulting signal $y_{res}$ of the processor (HAPU). Subject to a specific criterion, the adjustment unit is configured to adjust the parameter setting Θ to provide a second (preferably optimized) parameter setting Θ' that provides the desired speech intelligibility $I_{des}$ of the second processed signal $y_p(\Theta')$ to be presented to the user as the resulting signal $y_{res}$, if practically achievable. The specific criterion $y_{res}$, may be that $I(y) \leq I_{des}$, and $I(y_p(\Theta 1)) \geq I_{des}$. The optimized (second) parameter setting Θ' may depend on the user's estimated intelligibility I and/or on the apparent SNR of a current processed signal ($y_p(\Theta)$), and on the desired speech intelligibility measure $I_{des}$ (e.g. stored in a memory of the hearing aid). The optimized (second) parameter setting Θ' is used by the one or more processing algorithms of the signal processor (HAPU) to process the electric input signal y, and to provide the (second, optimized) processed signal $y_p(\Theta')$ (yielding the desired level of speech intelligibility to the user ($I_{des}$), if possible). In an embodiment, the resulting signal $y_{res}$ presented to the user is equal to the optimized second processed signal $y_p(\Theta')$, or to a further processed version thereof.

The embodiment of a hearing aid shown in FIG. 1A further comprises a detector unit (DET) comprising (or connected to) a number ND of (internal of external) sensors, each providing respective detector signals $det_1, det_2, \ldots, det_{ND}$. The controller (CONT) is configured to receive the detector signals from the detector unit (DET), and to influence the control of the processor (HAPU) in dependence thereof. The detector unit (DET) receives the electric input signal(s) y, but may additionally or alternatively receive signals from other sources. One or more of the detector signals may be based on analysis of the electric input signals(s) y. One or more of the detectors may be independent (or not directly dependent) of the electric input signals(s) y, e.g. providing optical signals, brain wave signals. eye gaze signals, etc., that contain information about signals in the environment, e.g. a target signal, e.g. it's timing, or its spatial origin, etc., or a noise signal (e.g. is distribution or specific location). The detector signals from the detector unit (DET) are provided by a number ND of sensors (detectors), e.g. an image sensor, e.g. a camera (e.g. directed to the face (mouth) of a current target speaker, e.g. for providing alternative (SNR-independent) information about the target signal, e.g. voice activity detection), a brain wave sensor, a movement sensor (e.g. a head tracker for providing head orientation for indication of direction of arrival (DoA) of a target signal), an EOG-sensor (e.g. for identifying DoA of a target signal, or indicating most probable DoAs).

In the embodiment of FIG. 1A the input unit (IU) is shown to provide only one electric input signal y. In general, a multitude of M electric input signals $y=y_1, \ldots, y_M$, may be provided (as e.g. illustrated in FIG. 2). In an embodiment M=2 or 3.

Figure 1B:
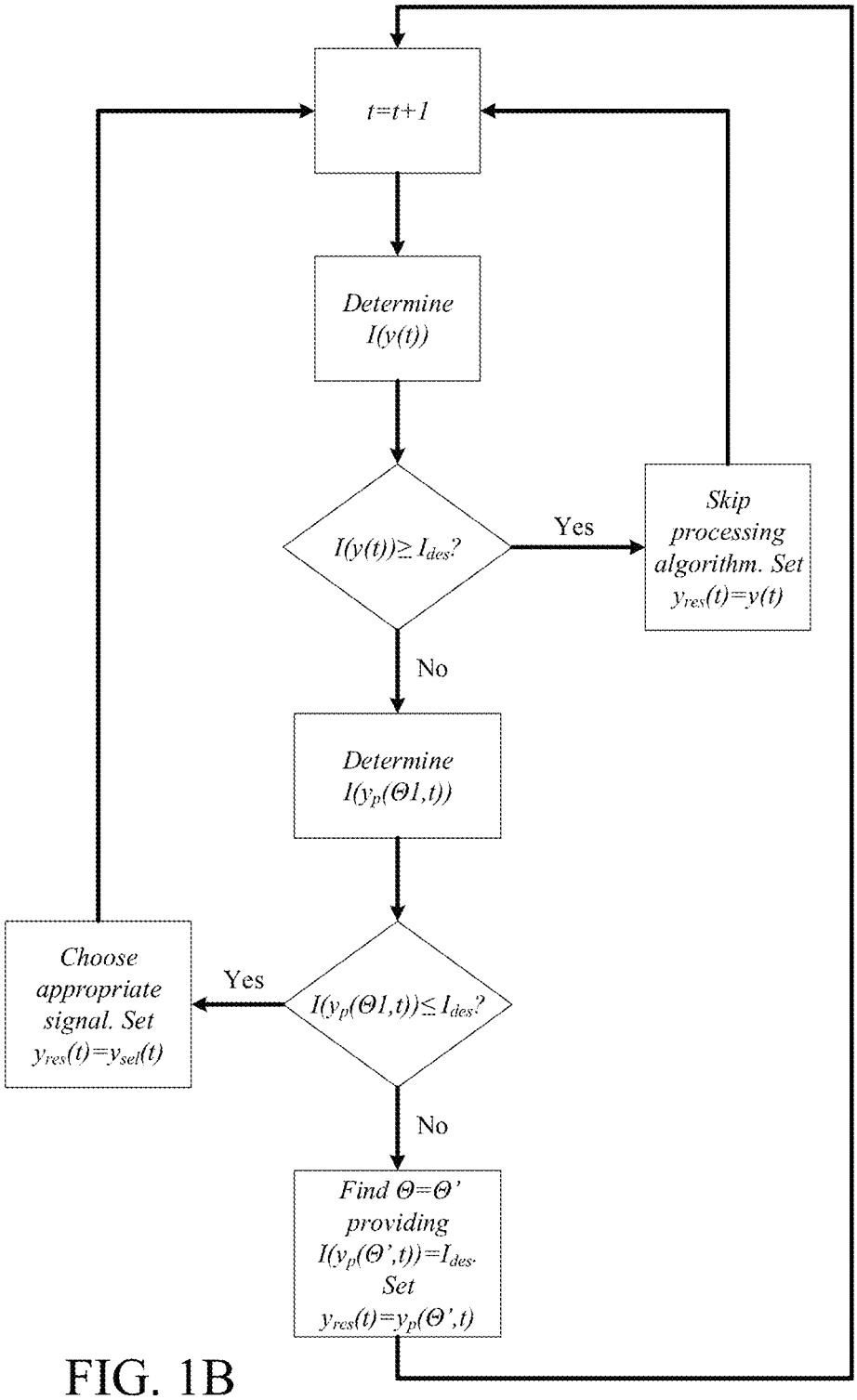
FIG. 1B illustrates a flow diagram for the functioning of a controller for providing a resulting signal $y_{res}$ according to an embodiment of the present disclosure.

FIG. 1B illustrates a flow diagram for the functioning of a controller (e.g. CONT in FIG. 1A) for providing a resulting signal $y_{res}$ in dependence of a speech intelligibility measure I (e.g. the 'speech intelligibility index' [5]) according to an embodiment of the present disclosure.

The embodiment of a controller (CONT) illustrated in FIG. 1B is configured to provide that the resulting signal $y_{res}$ is equal to the second processed signal $y_p(\Theta')$ (based on optimized parameter setting Θ') in case I(y) is smaller than the desired value $I_{des}$, and $I(y_p(\Theta 1))$ is larger than the desired value $I_{des}$ of the speech intelligibility measure I. The controller (CONT) is further configured to determine the second parameter setting Θ' under the constraint that the second processed signal $y_p(\Theta')$ exhibits the desired value $I_{des}$ of the speech intelligibility measure. This is explained in further detail in the following.

A speech intelligibility measure of one or more processed or un-processed signals is determined at successive points in time t. As indicated in FIG. 1B by unit or process step 't=t+1'. The successive points in time may e.g. be every successive time frame (defined by time frame index m) of the respective signals. Alternatively, successive points in time may indicate a lower rate, e.g. every $10^{th}$ time frame.

The controller is configured to control the processor to provide that the resulting signal $y_{res}$ at a current point in time t is equal to one of the electric input signals y, in case a current value I(y) of the speech intelligibility measure I for the electric input signal y in question (in FIG. 2 e.g. assumed to be $y_1$) is larger than or equal to a desired value $I_{des}$ of the speech intelligibility measure I (cf. respective units or process steps, 'Determine I(y(t))', '$I(y(t)) \geq I_{des}$?', and in case the latter is true (branch 'Yes'), unit or process step 'skip processing algorithm. Set $y_{res}(t)=y(t)$', and advance time to the next time index 't=t+1').

In case the statement '$I(y(t)) > I_{des}$?' is false (branch 'No'), i.e. if the speech intelligibility measure I of the number of electric input signals y is smaller than the desired value $I_{des}$, the controller is further configured to control the processor to provide that the resulting signal $y_{res}$ at the current point in time t in dependence of a predefined criterion. The predefined criterion is related to characteristics of a first processed signal $y_p(\Theta 1)$ based on a first parameter setting Θ1 of the processing algorithm in question, e.g. a parameter setting that maximizes an SNR or an intelligibility measure. In case, for example, that the current value $I(y_p(\Theta 1))$ of the speech intelligibility measure I for the first processed signal $y_p(\Theta 1)$ is smaller than or equal to the desired value $I_{des}$ of the speech intelligibility measure I (cf. respective units or process steps, 'Determine $I(y_p(\Theta 1,t))$', '$I(y_p(\Theta 1,t)) \leq I_{des}$?', (i.e. branch 'Yes'), in other words in case that the processing algorithm cannot compensate sufficiently for noise in the input signal, the unit or process step 'Chose appropriate signal $y_{sel}$. Set $y_{res}(t)=y_{sel}(t)$', e.g. according to a predefined criterion, e.g. in dependence of the size of the difference of $I_{des}-I(y_p(\Theta 1,t))$, and advance time to the next time index 't=t+1'). The selectable signal $y_{sel}$ may e.g. comprise or be an information signal indicating to the user that the target signal is of poor quality (and difficult to understand). The controller may e.g. be configured to control the processor to provide that (the selectable signal $y_{sel}$ and thus) the resulting signal $y_{res}$ at the current point in time t is equal to one of the electric input signals y, or equal to the first processed signal $y_p(\Theta 1)$, e.g. attenuated and/or superposed by an information signal (cf. e.g. $y_{inf}$ in FIG. 2).

In case the statement '$I(y_p(\Theta 1,t)) \leq I_{des}$?' is false (branch 'No'), i.e. if the speech intelligibility measure I of the processed signal $y_p(\Theta 1,t)$ is larger than the desired value $I_{des}$, the controller is further configured to determine a second parameter setting Θ' of the processing algorithm under the constraint that the second processed signal $y_p(\Theta')$ exhibits the desired value $I_{des}$ of the speech intelligibility measure, and to control the processor to provide that the resulting signal $y_{res}$ at the current point in time t is equal to the second, optimized, processed signal $y_p(\Theta')$ (cf. respective units or process steps, 'Find $\Theta'$ providing $I(y_p(\Theta,t)=I_{des}$. Set $y_{res}=y_p(\Theta',t)$', and advance time to the next time index 't=t+1').

The first parameter setting $\Theta 1$ may e.g. be a setting that maximizes a signal to noise ratio (SNR) and/or the speech intelligibility measure I of the first processed signal $y_p(\Theta 1)$. The second (optimized) parameter setting $\Theta'$ is e.g. a setting that (when applied by the one or more processing algorithms to process the number of electric input signal(s)) provides the second (optimized) processed signal $y_p(\Theta')$, which yields the desired level of speech intelligibility to the user, as reflected in the desired value $I_{des}$ of the speech intelligibility measure).

The one or more processing algorithms may e.g. be constituted by or comprise a single channel noise reduction algorithm. The single channel noise reduction algorithm is configured to receive a single electric signal, e.g. a signal from a (possibly omni-directional) microphone, or a spatially filtered signal, e.g. from a beamformer filtering unit. Alternatively or additionally, the one or more processing algorithms may be constituted by or comprise a beamformer algorithm for receiving a multitude of electric input signals, or processed versions thereof, and providing a spatially filtered, beamformed, signal. The controller (CONT) is configured to control the beamformer algorithm using specific beamformer settings. The first parameter setting $\Theta 1$ comprise a first beamformer setting, and the second parameter setting $\Theta'$ comprises a second (optimized) beamformer setting. The first beamformer settings are e.g. determined based on the multitude of electric input signals and one or more control signals, e.g. from one or more sensors (e.g. including a voice activity detector), without specifically considering a value of the speech intelligibility measure of the current beamformed signal. The first parameter setting $\Theta 1$ may constitute or comprise a beamformer setting that maximizes a (target) signal to noise ratio (SNR) of the (first) beamformed signal.

Example: Beamforming

In the following, the problem is illustrated by a beamforming (spatial filtering) algorithm. Beamforming/spatial filtering techniques provide the most efficient method for improving the speech intelligibility for hearing aid users in acoustically challenging environments. However, despite the benefits of beamformers in many situations, they come with negative side effects in other situations. The side effects include:

a) Oversuppression leading to loudness loss: in some situations, the beamformer/noise reduction system is "too efficient" and removes more noise than necessary. This has the negative side effect that the end user experiences a loss of loudness: the sound level simply becomes too low. Apart from being unable to understand the target speech signal, simply because of lack of audibility, the user also experiences a lack of "connectedness" to the auditory scene, since noise source are not only reduced in level, but completely eliminated.

b) Spatial cue distortions with binaural beamforming systems: in the situation, where a binaural beamforming system is employed, i.e., where microphone signals may be transmitted from one hearing aid to another, and where a beamformer is executed in the receiving hearing aid, it is well-known that the beamforming process may introduce spatial cue distortions. Specifically, if binaural minimum variance distortion-less response (MVDR) beamformers are employed, it is well known that the spatial cues of the background noise are distorted in a way that they become identical to those of the target sound. In other words, in the beamformer output, the noise sounds as if originating from the direction of the target source (which is confusing if the actual noise sources are located far away from the target source). In an embodiment, binaural noise reduction is only enabled in the case where the individual (monaural) beamformers do not provide a sufficient amount of help (e.g. speech intelligibility). Hereby the amount of transmitted data between the ears depend on the estimated speech intelligibility (and can be limited in amount and thus reduce power consumption of the binaural hearing aid system).

In the following, we use the term "beamforming" to cover any process, where multiple sensor signals (microphones or otherwise) are combined (linearly or otherwise) to form an enhanced signal with more desirable properties than the input signals. We are also going to use the terms "beamforming" and "noise reduction" interchangeably.

It is known that the problems above involve a trade-off between the amount of noise reduction and the amount of side effects.

For example, for an acoustic situation with a single point target signal source and a single point-like noise source, a maximum-noise-reduction beamformer is able to essentially eliminate the noise source by placing a spatial zero in its direction. Hence, the noise is removed maximally, but the end-user experiences a loss of loudness and a loss of "connectedness" to the acoustic world, because the point noise source is not only suppressed to a level that e.g. allows easy speech comprehension, but is completely eliminated.

Similarly, for a binaural beamforming setup with a point target source in an isotropic (diffuse) noise field, a minimum-variance-distortion-less-response (MVDR) binaural beamformer is going to reduce the noise level quite significantly, but the spatial cues of the processed noise are modified in the process. Specifically, whereas the original noise sounds as if originating from all directions, the noise experienced after beamforming sounds as if originating from a single direction, namely the target direction.

The proposed solution to these problems lies in the observation that often, maximum-noise-reduction is an overkill in terms of speech comprehension. The end-user might have been able to understand the target speech without difficulty, even if a milder noise reduction scheme had been applied and a milder noise reduction scheme would have caused much fewer of the side effects described above. Specifically, in the example with a target point source and an additive, point noise source, it could be sufficient to suppress the point noise source by 6 dB, say, to achieve a speech intelligibility of essentially 100%, rather than completely eliminating the noise point source. The idea of the proposed solution is to have the beamformer automatically find this desirable tradeoff and apply a noise reduction of 6 dB (for this situation) rather than eliminating the noise source. Furthermore, in situations where the general signal-to-noise ratio is already high enough that the user would understand speech without problems, the proposed beamformer would automatically detect this, and apply no spatial filtering.

In summary, the solution to the problem is to (automatically) find an appropriate tradeoff, namely the beamformer settings which lead to an acceptable speech intelligibility, but without overdoing the noise suppression.

In order to develop an algorithm that automatically determines the amount of spatial filtering/noise reduction necessary to achieve a sufficient speech intelligibility, a method is needed for judging the intelligibility of the signal to be presented for the user. To do so, the proposed solution relies on the very general assumption that the speech intelligibility I experienced by a (potentially hearing impaired) listener, is some function $f(\ )$ of the signal-to-noise ratios SNR(k,m,Φ,Θ) in relevant time-frequency tiles of the signal. The parameters k,m denote frequency and time, respectively. The variable Θ represents beamformer settings (or generally 'processing parameters of a processing algorithm'), e.g. the beamformer weights W used to linearly combine microphone signals. Obviously, the SNR of the output signal of a beamformer is a function of the beamformer settings. The parameter Φ represents a model/characterization of the auditory capabilities of the individual in question. Specifically, Φ could represent an audiogram, i.e., the hearing loss of the user, measured at pre-specified frequencies. Alternatively, it could represent the hearing threshold as a function of time and frequency, e.g. as estimated by an auditory model. The fact that the SNR is defined as a function of Φ anticipates that a potential hearing loss may be modelled as an additive noise source (in addition to any acoustic noise) which also degrades intelligibility hence, we often refer to the quantity SNR(k,m,Φ,Θ) as an apparent SNR [5].

Hence, we have $$I=f(\mathrm{SNR}(k,m,\Phi,\Theta))$$

Generally, the function $f(\ )$ is monotonically increasing with the SNR (SNR(k,m,Φ,Θ)) in each of the time-frequency tiles.

A well-known special case of this expression is the Extended Speech Intelligibility Index (ESII) [10], which may be approximated as (cf. [2]):

$$I=\frac{1}{M'\sum_{m=m'-M'+1}^{m'}\sum_{k=1}^{K}w_k\frac{SNR(k,m,\Phi,\Theta)}{SNR(k,m,\Phi,\Theta)+1}}$$

where $$w_k\geq 0,\ \sum_k w_k=1$$

denote so-called band-importance functions, SNR(k,m,Φ,Θ) is the (apparent) SNR in time-frequency tile (k,m), and where M' represents the number of time frames containing speech considered (e.g. corresponding to a recent syllable, or a word, or an entire sentence), and where K is the number of frequency bands considered, k=1, . . . , K. The frames containing speech may e.g. be identified by a voice (speech) activity detector, e.g. applied to one or more of the electric input signals.

In an embodiment, a first part of the processing (e.g. the processing of the electric input signals to provide first beamformer settings Θ(k',m)) is applied in individual frequency bands with a first frequency resolution, represented by a first frequency index k', and a second part of the processing (e.g. the determination of a speech intelligibility measure I for use in modifying the first beamformer settings Θ(k',m) to optimized beamformer settings Θ'(k',m), which provide a desired speech intelligibility $I_{des}$) is applied in individual frequency bands with a second (different, e.g. lower) frequency resolution, represented by a second frequency index k (see e.g. FIG. 3). The first and/or second frequency index (indices) may be uniformly, or non-uniformly, e.g. logarithmically, distributed across frequency. The second frequency resolution k may e.g. be based on one-third octave bands.

The basic idea is based on the following observations:

1) The SNR SNR (k,m,Φ) in each time frequency tile of a signal reaching a pre-specified hearing aid microphone may be estimated, e.g. using the method outlined in [6]. We have dropped the dependency on the beamformer parameter set Θ because this SNR is defined at a reference microphone, before any beamforming (or other processing) is applied to the signal.
2) The increase in SNR (k,m,Φ) due to signal processing in the hearing aid, e.g. independent beamforming in each of the subbands indexed by k, may also be estimated [6]. In other words, the (apparent) SNR SNR (k,m,Φ,Θ) of the signal reaching the eardrums of the listener may be estimated.
3) An estimate of the value of I that corresponds to a particular desired (minimum) speech intelligibility percentage for a particular user may be obtained during the fitting process of the hearing aid.
4) At run-time, the particular setting of the hearing aid signal processing, e.g., the beamformer setting, which leads to the desired I, but which otherwise changes the incoming signal as little as possible, may be identified and applied in the hearing aid.

Should it happen that the apparent SNR of the unprocessed signal (the electric input signal(s)) exceeds the desired speech intelligibility value $I_{des}$, no beamforming should be applied.

In the following, an example of a particular implementation of the basic idea described above. First, we outline, by way of example, how to compute SNR (k,m,Φ,Θ) for a given beamformer setting (section 1). To be able to explain this idea clearly, we use a simple example beamformer. The output of this example beamformer is a linear combination of the output of a minimum variance distortion-less response (MVDR) beamformer, and the noisy signal as observed at a pre-defined reference microphone. The coefficient in the linear combination controls the "aggressiveness" of the example beamformer. It is emphasized that this simple beamformer only serves as an example. The proposed idea is much more general and can be applied to other beamformer structures and to combinations of beamformers and single-microphone noise reduction systems, and to other processing algorithms, etc.

Next, we outline how to find the beamformer settings Θ, which achieve a pre-specified, desired intelligibility level, without unnecessarily over-suppressing the signal (section 2). As before, this description uses elements of the example beamformer introduced in section 1.

However, as before, the basic idea applies in a more general setting involving other types of beamformers, single-microphone noise reduction systems, etc.

1. SNR as Function of Beamformer Setting—Example

In this section we outline, by way of example, how to compute SNR (k,m,Φ) for a given beamformer setting.

Let us assume that an M—microphone hearing aid system is operated in a noisy environment. Specifically, let us assume that the r'th microphone signals is given by $$y_r(n)=x_r(n)+v_r(n),\ r=1,KM,$$

where $y_r(n)$, $x_r(n)$ and $v_r(n)$ denote the noisy, clean target, and noise signal, respectively, observed at the rth microphone. Let us assume that each microphone signal is passed through some analysis filterbank, leading to filter bank signals $Y(k,m)=[Y_1(k,m)\Lambda Y_M(k,m)]^T$, where k and $_m$ denote a subband index and a time index, respectively, and superscript $^T$ denotes transposition. We define the vectors $X(k,m)=[X_1(k,m)\Lambda X_M(k,m)]^T$ and $V(k,m)=[V_1(k,m)\Lambda V(k,m)]^T$ in a similar manner.

Let us, for the sake of the example, assume that we are going to apply a linear beamformer $W(k,m)=[W_1(k,m)\Lambda W_M(k,m)]^T$ to the noisy observations $Y(k,m)=[Y_1(k,m)\Lambda Y_M(k,m)]^T$ to form an enhanced output $$\hat{X}(k,m)=W^H(k,m)Y(k,m).$$

Let $d'(k,m)=[d'_1(k,m)\Lambda d'_M(k,m)]$ denote the acoustic transfer function from the target source to each microphone, and let $$d(k,m)=[d'_1(k,m)/d'_i(k,m)\Lambda d'_M(k,m)/d'_i(k,m)]$$

denote the relative acoustic transfer function wrt. the $i^{th}$ (reference) microphone [1]. Furthermore, let $$C_V(k,m)=E[V(k,m)V(k,m)^H]$$

denote the cross-power spectral density matrix of the noise. For later convenience, let us factorize $C_V(k,m)$ as [6], $$C_V(k,m)=\lambda_V(k,m)\Gamma_V(k,m)$$

where $\lambda_V(k,m)$ is the power spectral density of the noise at the reference microphone (the $i^{th}$ microphone), and $\Gamma_V(k,m)$ is the noise covariance matrix, normalized so that element (i,i) equals one, cf. [6].

With these definitions, we are in a position to specify in further detail our example beamformer. Let us assume that our example beamformer W(k,m) is of the form, $$W(k,m,\alpha_{k,m})=\alpha_{k,m}W_{MVDR}(k,m)+(1-\alpha_{k,m})e_i,$$

where $$W_{MVDR}(k,m)=\frac{C_V^{-1}(k,m)d(k,m)}{d^H(k,m)C_V^{-1}(k,m)d(k,m)}$$

denotes the weight vector of a minimum variance distortion-less response beamformer, and the vector $$e_i=[0\ldots1\ldots0],$$

where the 1 is located at index i (corresponding to the reference microphone), and $0\le\alpha_{k,m}\le1$ is a trade-off parameter, which determines the "aggressiveness" of the beamformer. Instead of the linear combination of the MVDR beamformer ($W_{MVDR}$) with an omni-directional beamformer (e) as proposed in this example, the aggressiveness of the beamformer may alternatively e.g. be defined by different sets of beamformer weights ($W_z$, z=1, . . . , $N_z$, where $N_z$ is the number of different degrees of aggressiveness of the beamformer). With $\alpha_{k,m}=1$, W(k,m) is identical to an MVDR beamformer (i.e., the most "aggressive" beamformer that can be used in this example), while with $\alpha_{k,m}=0$, W(k,m) does not apply any spatial filtering, so that the output of the beamformer is identical to the signal at the reference microphone (e.g. corresponding to the electric input signal from an omni-directional microphone).

With this example beamformer system in place, we can find the link between the beamformer settings ($\alpha_{k,m}$ in this example) and the resulting SNR(k,m,Φ,Θ). Here, we have introduced the additional parameter Θ, which represents the parameter set of the beamformer system, i.e., $\Theta=\{\alpha_{k,m}\}$, to indicate explicitly that the resulting SNR is a function of the beamformer setting.

To estimate SNR(k,m,Φ,Θ), the following procedure may be applied (we are applying specific maximum likelihood estimates below obviously, many other options exist).

1) Compute the maximum likelihood estimate $\hat{\lambda}_{x,ML}^{in}(k,m)$ of the power spectral density $\lambda_x^{in}(k,m)$ of the target speech signal reaching a pre-defined reference microphone [6].
2) Compute the maximum likelihood estimate $\hat{\lambda}_{v,ML}^{in}(k,m)$ of the power spectral density $\lambda_v^{in}(k,m)$ of the noise component reaching a pre-defined reference microphone [6].
3) Compute an estimate of the SNR at the reference microphone $$\mathrm{SNR}(k,m,\Phi)=\max(\hat{\lambda}_{x,ML}^{in}(k,m)/\hat{\lambda}_{v,ML}^{in}(k,m),\varepsilon),$$

where $\varepsilon\ge0$ is a scalar introduced to avoid negative SNR estimates (and/or numerical problems).
4) Compute an estimate of the speech power spectral density at the output of the beamformer, $$\hat{\lambda}_{x,ML}^{out}(k,m)=\hat{\lambda}_{v,ML}^{in}|W^H(k,m,\alpha_{k,m})d(k,m)|^2.$$

5) Compute an estimate of the noise power spectral density at the output of the beamformer, $$\hat{\lambda}_{v,ML}^{out}(k,m)=\hat{\lambda}_{v,ML}^{in}W^H(k,m,\alpha_{k,m})\Gamma_V(k,m)W(k,m,\alpha_{k,m}).$$

6) Compute an estimate of the apparent noise power spectral density $\hat{\lambda}_{v,App}^{out}(k,m)$ at the output of the beamformer by modifying the noise power spectral density estimate $\hat{\lambda}_{v,ML}^{out}(k,m)$ in order to take the hearing threshold T(k,m) of the user into account. Several reasonable modifications exist, e.g. [5]

$$\hat{\lambda}_{v,App}^{out}(k,m)=\max(\hat{\lambda}_{v,ML}^{out}(k,m),T(k,m)),$$

or $$\hat{\lambda}_{v,App}^{out}(k,m)=\hat{\lambda}_{v,ML}^{out}(k,m)+T(k,m).$$

7) Compute an estimate of the apparent SNR at the output of the beamformer, $$\mathrm{SNR}(k,m,\Phi,\Theta)=\max(\hat{\lambda}_{x,ML}^{out}(k,m)/\hat{\lambda}_{v,App}^{out}(k,m),\varepsilon),$$

2. How to Find the Beamformer Settings, which Achieve a Pre-Specified, Desired Intelligibility Level, without Unnecessarily Over-Suppressing the Signal. Example We now outline a procedure to find the desired beamformer settings Θ which achieve a desired speech intelligibility level. In principle, the search for these settings may be divided into the following three situations:

i) the desired speech intelligibility level can be achieved (or is exceeded) without any beamforming,
ii) the set of most aggressive beamformers are not sufficient to achieve the desired speech intelligibility, and
iii) one or more beamformer settings exist, that lead to the desired speech intelligibility level. In this situation, the beamformer setting (amongst the settings leading to the desired intelligibility) is chosen, which optimize other criteria, e.g. least modification of the original signal, least total noise power reduction (e.g. to maintain awareness of the acoustic environment), the setting that maintain the direction of the spatial minima of the beam pattern, etc., as e.g. described in our co-pending European patent application number 17164221.8, filed on 31 Mar. 2017 with the European Patent Office, and having the title A hearing device comprising a beamformer filtering unit.

Let us assume that a value $I_{desired}$ reflecting the desired level of speech intelligibility is available. This value could, for example, have been established when the hearing aid system was fitted by the audiologist. Then, the proposed approach may be outlined as follows.

1)

a) Compute SNR $(k,m,\Phi,\Theta)$ for the situations where the beamforming system is absent (for the example above, this situation is described by $\Theta=\{\alpha_{k,m}=0\}$.

b) Compute the resulting estimated speech intelligibility $I=f(SNR(k,m,\Phi,\Theta))$.

c) If $I \geq I_{desired}$, the unprocessed signal is already sufficiently understandable, and the beamforming system should remain absent. Otherwise, continue to Step 2 below.

2)

a) Compute SNR $(k,m,\Phi,\Theta)$ for the situations where the beamforming system is in its most aggressive setting (for the example above, this situation is described by $\Theta=\{\alpha_{k,m}=1\}$.

b) Compute the resulting estimated speech intelligibility $I=f(SNR(k,m,\Phi,\Theta))$.

c) If $I \leq I_{desired}$, the desired intelligibility cannot be achieved, even for a maximally processed signal. The signal presented to the user could be the maximally processed signal (but other options reflecting the knowledge that the signal is not of sufficient intelligibility may be used: it might, for example, be decided to avoid the aggressive beamformer setting and choose a "milder" setting). If the maximally processed signal leads to an intelligibility that is higher than necessary, $I>I_{desired}$, continue to Step 3 below.

3)

a) Identify the (potentially multiple) parameter settings $\Theta$ which achieve $I=I_{desired}$, and which process the incoming signal the least, e.g., the beamformer settings which reduce the total noise power at the output of the beamformer the least, or the beamformer settings which lead to maximum total signal loudness, the beamformer settings that best maintain the direction and value of the spatial minima of the beam pattern, etc. (several such secondary requirements may be envisioned). This may, e.g., be done by introducing the Karush-Kuhn Tucker conditions (cf. p 243 in [4]) and identifying the beamformer parameter settings, which satisfy these conditions, see [2, 3] for examples.

Figure 2:
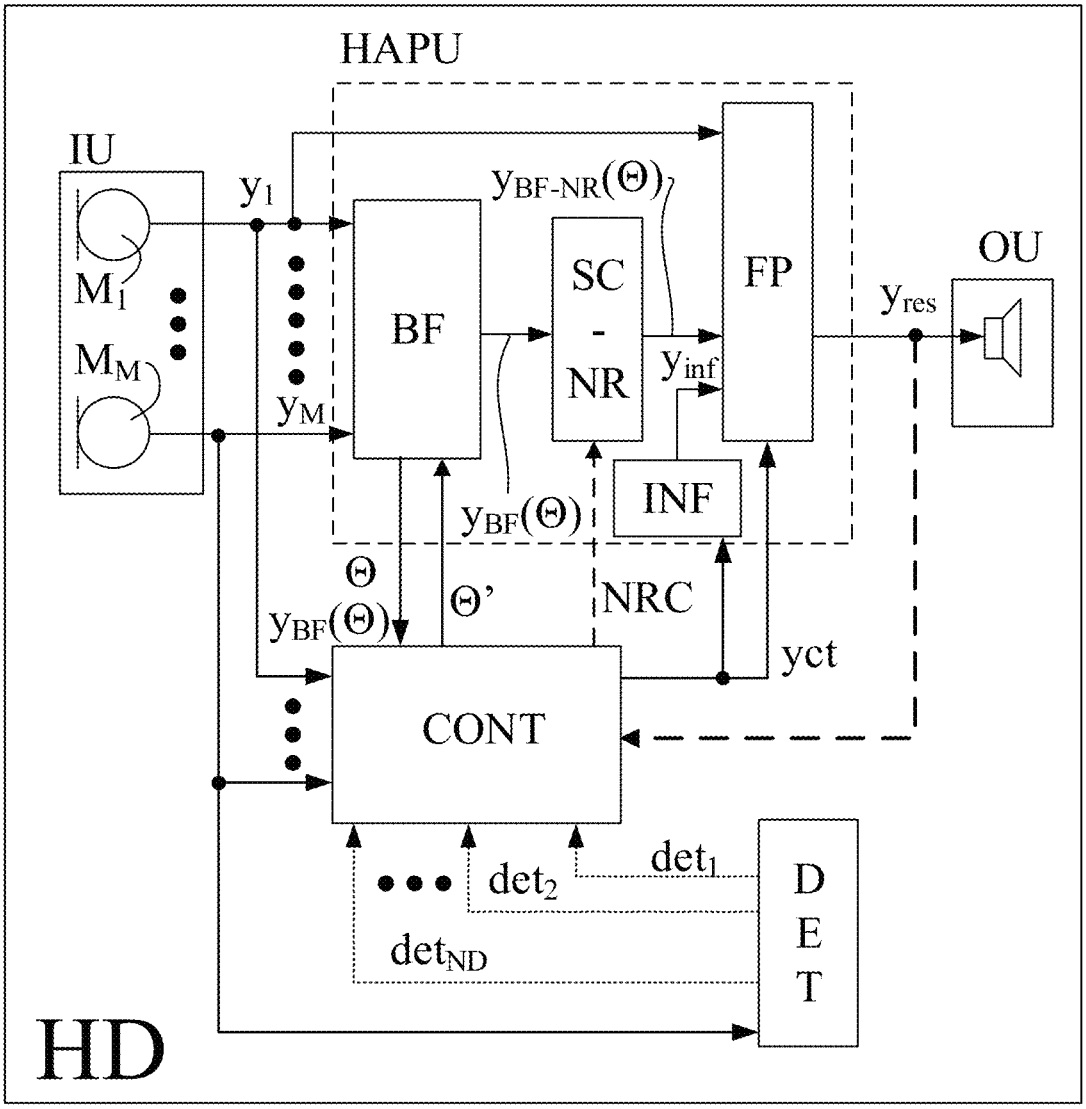
FIG. 2 shows an embodiment of a hearing aid according to the present disclosure comprising a multitude of input transducers and a beamformer for spatially filtering the electric input signals, FIG. 3A schematically shows in the upper part an analogue electric (time domain) input signal representing sound, digital sampling of the analogue signal, and in the lower part two different schemes for arranging the samples in non-overlapping and overlapping time frames, respectively, and FIG. 3B schematically shows a time frequency representation of the electric input signal of FIG. 3A as a map of time frequency tiles (k',m), where k' and m are frequency and time indices, respectively.

FIG. 2 shows an embodiment of a hearing aid according to the present disclosure comprising a multitude of input transducers and a beamformer (BF) for spatially filtering the electric input signals $y_r$. The embodiment of a hearing aid (HD) in FIG. 2 comprises the same functional elements as the embodiment of FIG. 1A, 1B, namely:

A) a forward path for receiving a number of electric input signals comprising sound, processing said input signals, and delivering a resulting signal for presentation to a user, the forward path comprising A1) input unit (IU), A2) signal processor (HAPU), and A3) output unit (OU), and B) an analysis and control part comprising B1) detector unit (DET), and B2) control unit (CONT).

The general function of these elements are as discussed in connection with FIG. 1A, 1B. The differences of the embodiment of FIG. 2 compared to the embodiment of FIG. 1A, 1B are outlined in the following.

The input unit (IU) comprises a multitude (≥2) of microphones $(M_1, \ldots, M_M)$, each providing an electric input signal $y_r$, r=1, . . . , M, each representing sound in the environment of the hearing aid (or the user wearing the hearing aid). The input unit (IU) may e.g. comprise analogue to digital converters and time domain to frequency domain converters (e.g. filter banks) as appropriate for the processing algorithms and analysis and control thereof.

The signal processor (HAPU) is configured to execute one or more processing algorithms. The signal processor (HAPU) comprises a beamformer filtering unit (BF) and is configured to execute a beamformer algorithm. The beamformer filtering unit (BF) receives the multitude of electric input signals $y_r$, r=1, . . . , M from the input unit (IU), or processed versions thereof, and is configured to provide a spatially filtered, beamformed, signal $y_{BF}$. The beamformer algorithm and thus the beamformed signal, is controlled by beamformer parameter settings $\Theta$. A default first parameter setting $\Theta 1$ of the beamformer algorithm is e.g. determined based on the multitude of electric input signals $y_r$, r=1, . . . , M, and optionally one or more control signals $(det_1, det_2, \ldots, det_{ND})$, e.g. from one or more sensors (e.g. including a voice activity detector), to maximize a signal to noise ratio of the beamformed signal $y_{BF}$, with or without specifically considering a value of the speech intelligibility measure I of the current beamformed signal $y_{BF}$. The first parameter setting $\Theta 1$, and/or the beamformed signal $y_{BF}$ $(\Theta 1)$ based thereon, is/are fed to the control unit (CONT) together with at least one (here all) of the electric input signals $y_r$, r=1, . . . , M. An estimate of the intelligibility $I(y_{BF}(\Theta))$ of the beamformed signal $y_{BF}(\Theta)$ based on the first parameter setting $\Theta 1$ (and the user's hearing profile, e.g. reflecting an impairment, $\Phi$) is provided by the speech intelligibility estimator (ESI, cf. FIG. 1A) and fed to the adjustment unit (ADJ, cf. FIG. 1A) for (in dependence on predefined criteria, and if possible, cf. FIG. 1B and description thereof) adjusting (optimizing) the parameter setting $\Theta$ to provide a second parameter setting $\Theta'$ that provides the desired speech intelligibility $I_{des}$ of the processed signal $y_{res}$ presented to the user. The controller, e.g. the adjustment unit (ADJ, cf. FIG. 1A), receives as inputs a) the multitude of electric input signals $y_r$, r=1, . . . , M, b) the estimated speech intelligibility $I(y_r)$ of at least one of the multitude of electric input signals $y_r$, c) the first parameter setting $\Theta 1$, and/or the beamformed signal $y_{BF}(\Theta 1)$ based thereon, d) the desired speech intelligibility $I_{des}$, and e) the estimated speech intelligibility $I(y_{BF}(\Theta 1))$ of the beamformed signal $y_{BF}(\Theta 1)$ based on the first parameter setting $\Theta 1$. Based on these inputs (a, b, c, d), the controller provides a second parameter setting $\Theta'$ that is fed to the beamformer filtering unit (BF) and applied to the electric input signals $y_r$, r=1, . . . , M, to provide the optimized beamformed signal $y_{BF}(\Theta')$ based thereon (under the conditions discussed above).

The signal processor (HAPU) of the embodiment of FIG. 2 further comprises a single channel noise reduction unit (SC-NR) (also termed 'post filter') for further attenuating noisy parts of the spatially filtered signal $y_{BF}(\Theta)$ and providing a further noise reduced signal $y_{BF\text{-}NR}(\Theta)$. The single channel noise reduction unit (SC-NR) receives control signal NRC, e.g. configured to control which parts of the spatially filtered signal $y_{BF}(\Theta)$ that are eligible for attenuation (noise) and which parts should be left unaltered (target) to achieve that $I(y_{BF}(\Theta'))$=/des. The control signal NRC may e.g. be based on or influenced by one or more of the detector signals $(det_1, det_2, \ldots, det_{ND})$, e.g. from detector signals indicating the time-frequency-units, where speech is not present, and/or from a target cancelling beamformer (also termed 'blocking matrix'), cf. e.g. EP2701145A1.

The signal processor (HAPU) of the embodiment of FIG. 2 further comprises a (further) processing unit (FP) for providing further processing of the noise reduced signal $y_{BF\text{-}NR}(\Theta)$. Such further processing may e.g. include one or more of decorrelation measures (e.g. a small frequency shift) to reduce a risk of feedback, level compression to compensate for the user's hearing impairment, etc. The (further) processed signal $y_{res}$ is provided as an output of the signal processor (HAPU) and fed to the output unit (OU) for presentation to the user as an estimate of the target signal of current interest to the user. The (further) processed signal $y_{ref}$ is (optionally) fed to the control unit, e.g. to allow a check (and optionally ensure) that the speech intelligibility measure $I(y_{res})$ reflects the desired speech intelligibility value $I_{des}$, e.g. as part of an iterative procedure to determine second optimized parameter setting Θ'. In an embodiment, the signal processor is configured to control the processing algorithms of the further processing unit (FP) based on the estimated speech intelligibility I, as hearing loss compensation also form part of restoring intelligibility. In other words, one or more of the processing algorithms of the further processing unit (e.g. compressive amplification) may be included in the scheme according to the present disclosure.

The signal processor (HAPU) of the embodiment of FIG. 2 further comprises an information unit (INF) configured to provide an information signal $y_{inf}$, which e.g. can contain cues or a spoken signal to inform the user about a current status of the estimated intelligibility of the target signal, e.g. that a poor intelligibility is to be expected. The signal processor (HAPU) may be configured to include the information signal in the resulting signal, e.g. add it to one of the electric input signals or to a processed signal providing the best estimate of speech intelligibility (or to present it alone, e.g. depending on the current values of estimated speech intelligibility, as proposed in the present disclosure).

Examples of Processing Algorithms that May Benefit from the Proposed Scheme:

Beamforming (e.g. monaural beamforming) is—as described in the above example—an important candidate for use of the processing optimization scheme of the present disclosure. The first parameter setting Θ and the optimized parameter setting Θ' (incurred by the proposed scheme) typically include frequency and time dependent beamformer weights W(k,m).

Another processing algorithm is binaural beamforming, where beamformer weights $W_L$ and $W_R$ for a left and right hearing aid, respectively, are optimized according to the present disclosure, e.g. according to the present scheme:

$$W_L=\alpha_{k,m}W_{L,mvdr}+(1-\alpha_{k,m})e_L$$

$$W_R=\alpha_{k,m}W_{R,mvdr}+(1-\alpha_{k,m})e_R$$

where $W_{L,mvdr}$ and $W_{R,mvdr}$ denote the weight vector of a minimum variance distortion-less response beamformer or the left and right hearing aids, respectively, and the vectors eL and eR have the form $$e_{x,i}=[0\ldots1\ldots0],$$

where x=L, R, and the 1 is located at index i (corresponding to a reference microphone), and where $0\leq\alpha_{k,m}\leq1$ is a trade-off parameter, which determines the "aggressiveness" of the beamformer.

Still another processing algorithm is single channel noise reduction, where relevant parameter settings (Θ, Θ') would include weights $g_{k',m}$, applied to each time frequency tile, e.g. of a beamformed signal, where the frequency index k' has a finer resolution than the frequency index k (e.g. of speech intelligibility estimate I, cf. e.g. FIG. 3B) in order to be able to modify SNR on a time-frequency tile basis.

Figure 3A:
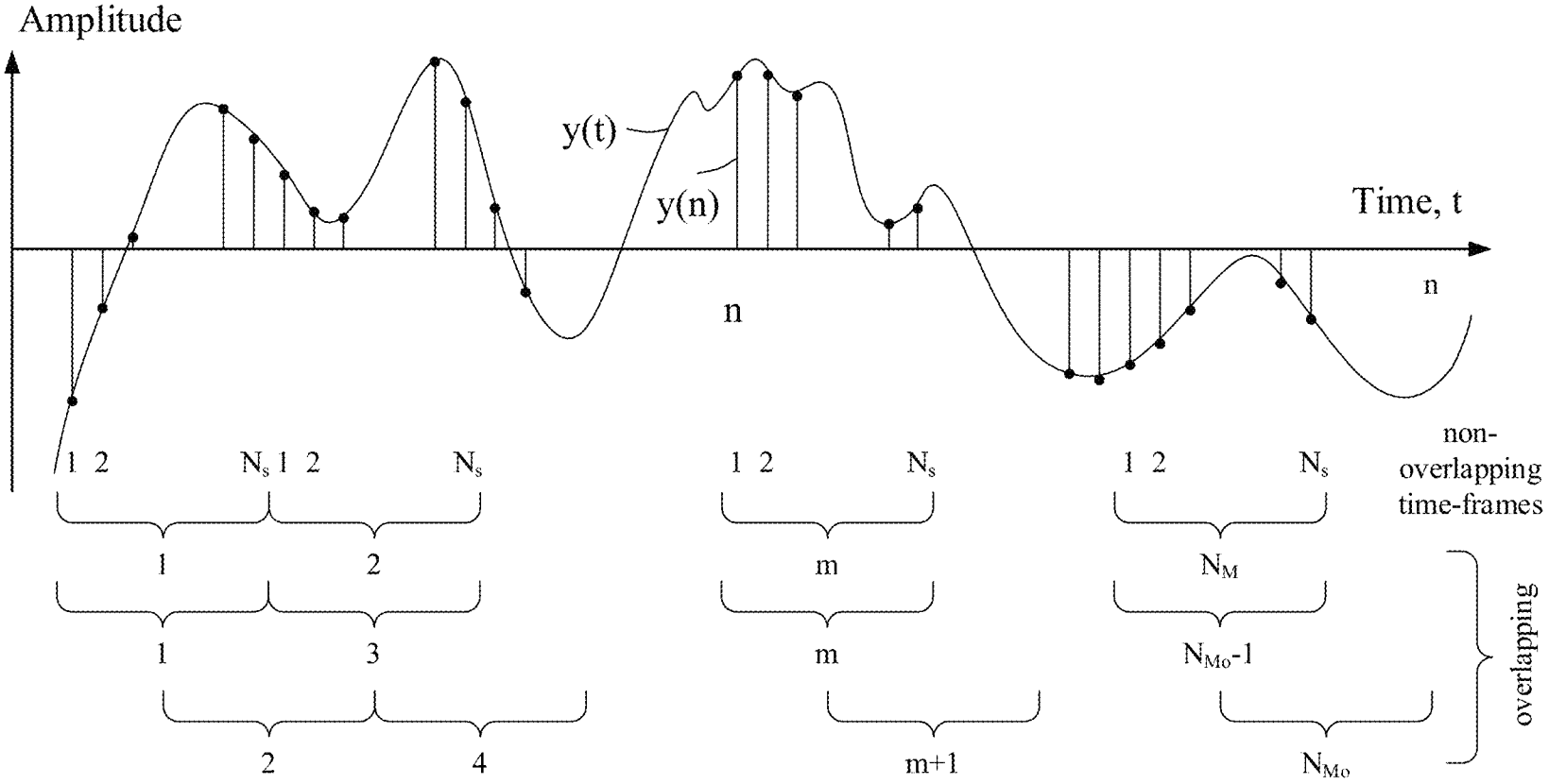

FIG. 3A schematically shows a time variant analogue signal y(t) (Amplitude vs time) and its digitization in samples y(n), the samples being arranged in a number of time frames, each comprising a number $N_s$ of digital samples. FIG. 3A shows an analogue electric signal (solid graph, y(t)), e.g. representing an acoustic input signal, e.g. from a microphone, which is converted to a digital audio signal (digital electric input signal) in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples y(n) at discrete points in time n, as indicated by the vertical lines extending from the time axis with solid dots at their endpoints (nearly) coinciding with the graph (depending on the number of bits $N_b$ in the digital representation), and representing its digital sample value at the corresponding distinct point in time n. Each (audio) sample y(n) represents the value of the acoustic signal at time n (or to) by a predefined number $N_b$ of bits, $N_b$ being e.g. in the range from 1 to 48 bit, e.g. 24 bits. Each audio sample is hence quantized using $N_b$ bits (resulting in $2^{Nb}$ different possible values of the audio sample).

In an analogue to digital (AD) process, a digital sample y(n) has a length in time of $1/f_s$, e.g. 50 μs, for $f_s$=20 kHz. A number of (audio) samples $N_s$ are e.g. arranged in a time frame, as schematically illustrated in the lower part of FIG. 3A, where the individual (here uniformly spaced) samples are grouped in time frames (1, 2, . . . , $N_s$)). As also illustrated in the lower part of FIG. 3A, the time frames may be arranged consecutively to be non-overlapping (time frames 1, 2, . . . , m, . . . , $N_M$) or overlapping (here 50%, time frames 1, 2, . . . , m, . . . , $N_{Mo}$), where m is time frame index. In an embodiment, a time frame comprises 64 audio data samples. Other frame lengths may be used depending on the practical application.

Figure 3B:
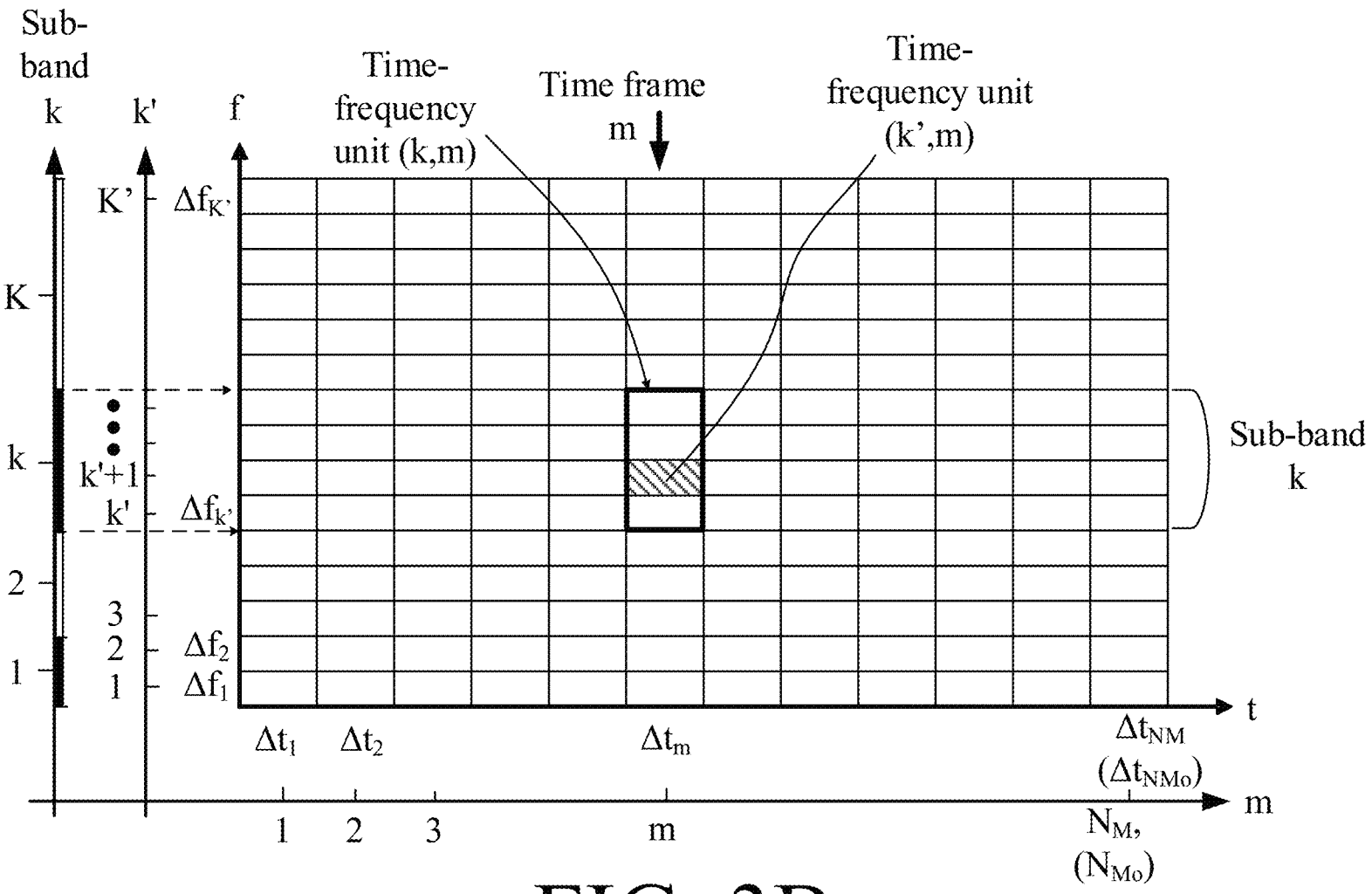

FIG. 3B schematically shows a time frequency representation of the (digitized) electric input signal y(n) of FIG. 3A as a map of time frequency tiles (k',m), where k' and m are frequency and time indices, respectively. The time-frequency representation comprises an array or map of corresponding complex or real values of the signal in a particular time and frequency range. The time-frequency representation may e.g. be a result of a Fourier transformation converting the time variant input signal y(n) to a (time variant) signal Y(k',m) in the time-frequency domain. In an embodiment, the Fourier transformation comprises a discrete Fourier transform algorithm (DFT), e.g. a short-time Fourier transform algorithm (STFT). The frequency range considered by a typical hearing aid (e.g. a hearing aid) from a minimum frequency $f_{min}$ to a maximum frequency $f_{max}$ comprises a part of the typical human audible frequency range from 20 Hz to 20 kHz, e.g. a part of the range from 20 Hz to 12 kHz. In FIG. 3B, the time-frequency representation Y(k',m) of signal y(n) comprises complex values of magnitude and/or phase of the signal in a number of DFT-bins (or tiles) defined by indices (k',m), where k'=1, . . . , K' represents a number K' of frequency values (cf. vertical k'-axis in FIG. 3B) and m=1, . . . , $N_M$ (or $N_{Mo}$) represents a number $N_M$ (or $N_{Mo}$) of time frames (cf. horizontal m-axis in FIG. 3B). A time frame is defined by a specific time index m and the corresponding K' DFT-bins (cf. indication of Time frame m in FIG. 3B). A time frame m represents a frequency spectrum of signal y at time m. A DFT-bin or tile (k',m) comprising a (real) or complex value Y(k',m) of the signal in question is illustrated in FIG. 3B by hatching of the corresponding field in the time-frequency map. Each value of the frequency index k' corresponds to a frequency range $\Delta f_{k'}$, as indicated in FIG. 3B by the vertical frequency axis $f$. Each value of the time index m represents a time frame. The time $\Delta t_m$ spanned by consecutive time indices depends on the length of a time frame and the degree of overlap between neighbouring time frames (cf. horizontal t-axis in FIG. 3B).

In the leftmost axis of FIG. 3B, a number K of (non-uniform) frequency sub-bands with sub-band indices k=1, 2, . . . , K is defined, each sub-band comprising one or more DFT-bins (cf. vertical Sub-band k-axis in FIG. 3B). The $k^{th}$ sub-band (indicated by Sub-band k) in the right part of FIG. 3B) comprises a number of DFT-bins (or tiles). A specific time-frequency unit (k,m) is defined by a specific time index m and a number of DFT-bin indices, as indicated in FIG. 3B by the bold framing around the corresponding DFT-bins (or tiles). A specific time-frequency unit (k,m) contains complex or real values of the $k^{th}$ sub-band signal Y(k,m) at time m. In an embodiment, the frequency sub-bands are one-third octave bands.

The two frequency index scales k and k' represent two different levels of frequency resolution (a first, higher (index k'), and a second, lower (index k) frequency resolution). The two frequency scales may e.g. be used for processing in different parts of the processor or controller. In an embodiment, the controller (CONT in FIG. 1, 2) is configured to determine a signal to noise ratio SNR for estimating a speech intelligibility measure I for use in modifying processing settings Θ(k',m) to optimized processing settings Θ'(k',m), which provide a desired speech intelligibility $I_{des}$ with a first frequency resolution (index k') that is finer than a second frequency resolution (index k) that is used to determine said speech intelligibility measure I(k,m), which is typically estimated in one-third octave frequency bands.

Figure 4A:
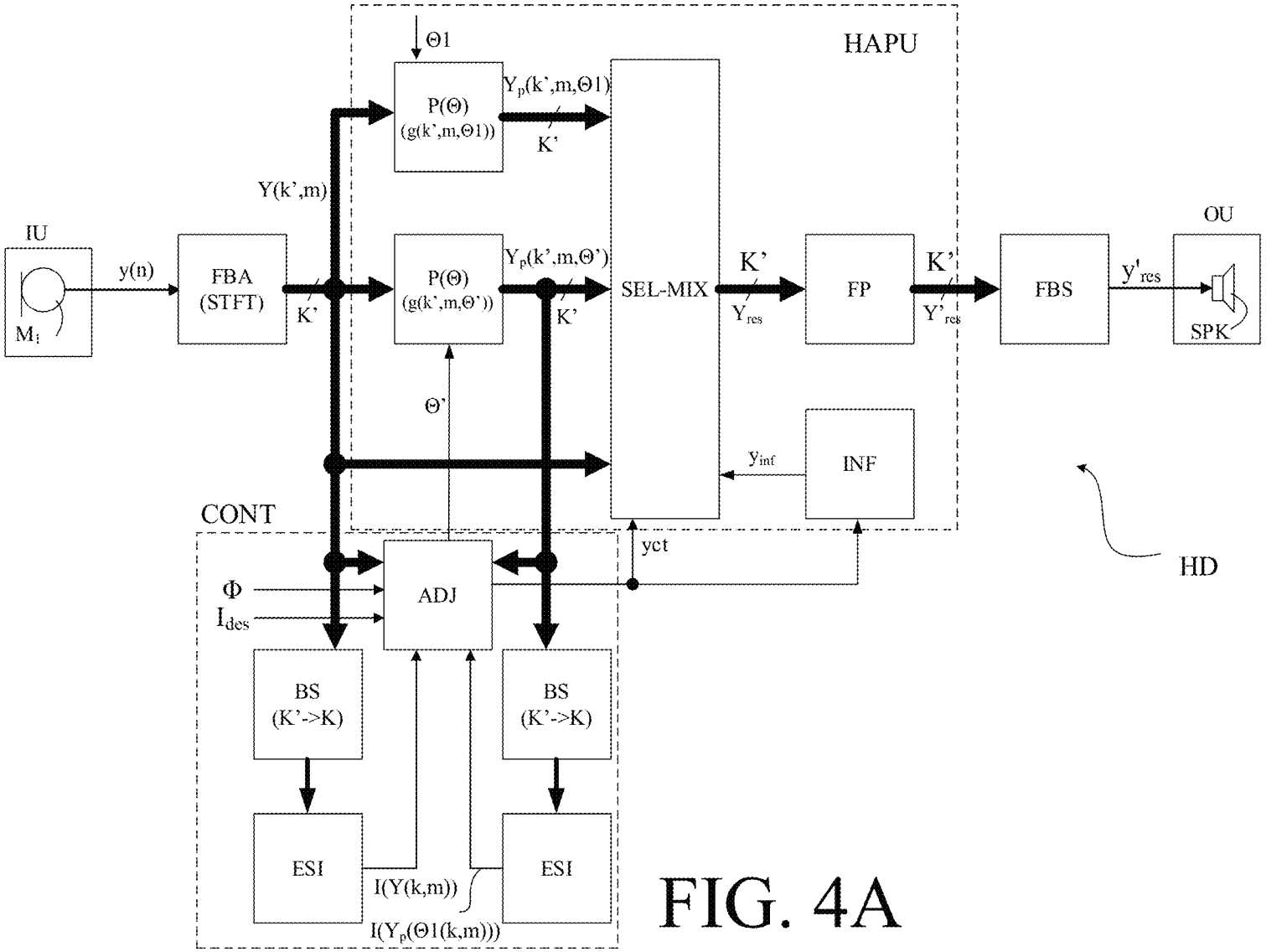
FIG. 4A shows a block diagram of a first embodiment of a hearing aid illustrating the use of 'dual resolution' in the time-frequency processing of signals of the hearing aid according to the present disclosure.

FIG. 4A shows a block diagram of a hearing device illustrating an exemplary use of 'dual resolution' of frequency indices (denoted k' and k, k'=1, . . . , K', and k=1, . . . , K, respectively, where K'>K) in the time-frequency processing of signals of the hearing device. The hearing device (HD), e.g. a hearing aid, comprises an input unit (IU) comprising a microphone $M_1$, here a single microphone, providing a (digitized) time domain electric input signal y(n), where n is a time index (e.g. a sample index). Multiple sound inputs $y_r$, r=1, . . . , M, may be provided, depending on the processing algorithm P(Θ), e.g. for a beamforming algorithm (cf. e.g. FIG. 2). The hearing device comprises an analysis filter bank (FBA), e.g. comprising a short time Fourier transform (STFT) algorithm for converting the time domain signal y(n) to K' frequency sub-band signals Y(k',m). In the embodiment of FIG. 4A, the forward path for processing the input signal(s) comprises three parallel paths that are fed from the analysis filter bank (FBA) to a selection or mixing unit (SEL-MIX) for providing the resulting signal $y_{res}$ in K' frequency sub-bands. The signal processor (HAPU, cf. dashed enclosure) of the forward path comprises first and second processing units P(Θ) representing processing algorithm P executed with first and second parameter settings Θ1 and Θ', respectively, the selection or mixing unit (SEL-MIX), an information unit (INF), and a further processing unit (FP). The forward path further comprises a synthesis filter bank (FBS) for converting K' further processed resulting frequency sub-band signals $Y'_{res}$ to corresponding time domain signal $y'_{res}(n)$, and output unit (OU), here comprising loudspeaker (SPK) for converting further processed resulting signal $y'_{res}(n)$ to a sound signal for presentation to the user.

The first (upper) signal path of the forward path in FIG. 4A comprises processing algorithm P(Θ) providing first processed signal $y_p(k',m,\Theta 1)$ in K' frequency bands resulting from processing algorithm P(Θ) with the first parameter setting Θ1 (cf. input Θ1) applied to a the number of electric input signals Y(k',m) (here one electric input signal). The first parameter setting Θ1 is e.g. represented by gains g(k',m,Θ1), exhibiting a (possibly complex) gain value g for each time-frequency index (k',m) (k'=1, K'); in other words, $$y_p(k',m,\Theta 1)=Y(k',m)*g(k',m,\Theta 1).$$

The second (middle) signal path of the forward path in FIG. 4A comprises processing algorithm P(Θ) providing first processed signal $y_p(k',m,\Theta')$ in K' frequency bands resulting from processing algorithm P(Θ) with the second (optimized) parameter setting Θ' (cf. input Θ' from controller (CONT)) applied to a the number of electric input signals Y(k',m) (here one electric input signal). The second parameter setting Θ' is e.g. represented by gains g(k',m,Θ'), exhibiting a (possibly complex) gain value g for each time-frequency index (k',m) (k'=1, K'); in other words, $$Y_p(k',m,\Theta')=Y(k',m)*g(k',m,\Theta').$$

A given parameter setting Θ (comprising individual g(k',m,Θ)=$g_\Theta$(k',m)) is thus calculated in each time-frequency unit (k',m), cf. hatched rectangle in FIG. 3B. The corresponding speech intelligibility measure I(Θ) may be determined in lower frequency resolution k. In the example of FIG. 3B, the speech intelligibility measure I(Θ) would have one value in time frequency unit (k,m) (indicated by bold outline in FIG. 3B), whereas the parameter setting Θ would have four values $g_\Theta$(k',m) in the same (bold) time-frequency unit (k,m). Thereby the parameter setting Θ (gains $g_\Theta$(k',m)) may be adjusted in fine steps to provide the second parameter setting Θ'(gains $g_{\Theta'}$(k',m)) exhibiting a desired estimate of speech intelligibility $I_{des}$.

The third (lower) signal path of the forward path in FIG. 4A feeds electric input signal Y(k',m) K' frequency bands from the analysis filter bank FBA to the selection or mixing unit.

The controller (CONT), cf. dashed outline comprising two separate analysis paths, and adjustment unit (ADJ), provides the second (optimized) parameter setting Θ' to the processor (HAPU). Each analysis path comprises 'band sum' unit (BS) for converting K' frequency sub-bands to K frequency sub-bands (indicated by K'->K), thus providing respective input signals in K frequency bands (TF-units (k,m)). Each analysis path further comprises a speech intelligibility estimator ESI for providing an estimate of a user's intelligibility of speech I (in K frequency sub-bands) in the input signal in question. The first (leftmost in FIG. 4A) analysis path provides an estimate of the user's intelligibility I(Y(k,m)) of the electric input signal Y(k,m), and the second (rightmost) analysis path provides an estimate of the user's intelligibility I($Y_p$(k,m)) of the first processed electric input signal $y_p$(Θ1(k,m)). Based on the estimates of the user's intelligibility I of speech in the electric input signal Y(k,m) and in the first processed electric input signal $Y_p$(Θ1(k,m)), and on a desired speech intelligibility of the user $I_{des}$, and possibly on a parameter set representing the user's hearing profile Φ, the adjustment unit (ADJ) determines control signal yct which is fed to the signal processor (HAPU), and configured to control the resulting signal $y_{res}$ from the selection or mixing unit (SEL-MIX) of the signal processor. The second (optimized) parameter setting Θ' and the resulting signal (controlled by control signal yct) is determined in accordance with the present disclosure, e.g. in an iterative procedure, cf. e.g. FIG. 1B or FIG. 6. The control signal yct is fed from the adjustment unit (ADJ) of the controller (CONT) to the selection or mixing unit (SEL-MIX) and to the information unit (INF).

The information unit (INF) (e.g. forming part of the signal processor (HAPU)) provides an information signal y inf (either as a time domain signal, or as a time-frequency domain (frequency sub-band) signal $Y_{inf}$), which is configured to indicate to the user a status of the present acoustic situation regarding the estimated speech intelligibility I, in particular (or solely) in case the intelligibility is estimated to be sub-optimal (e.g. below the desired speech intelligibility measure $I_{des}$, or below a (first) threshold value $I_{th}$). The information signal may contain a spoken message (e.g. stored in a memory of the hearing device or generated from an algorithm).

The further processing unit (FP) provides further processing of the resulting signal $Y_{res}(k',m)$ and provides a further processed signal $Y'_{res}(k',m)$ in K' frequency sub-bands. The further processing may e.g. comprise the application of a frequency and/or level dependent gain (or attenuation) g(k',m) of the resulting signal $Y_{res}(k',m)$ to compensate for a hearing impairment of the user (or to further compensate for a difficult listening situation of a normally hearing user), according to a hearing profile Φ of the user.

Figure 4B:
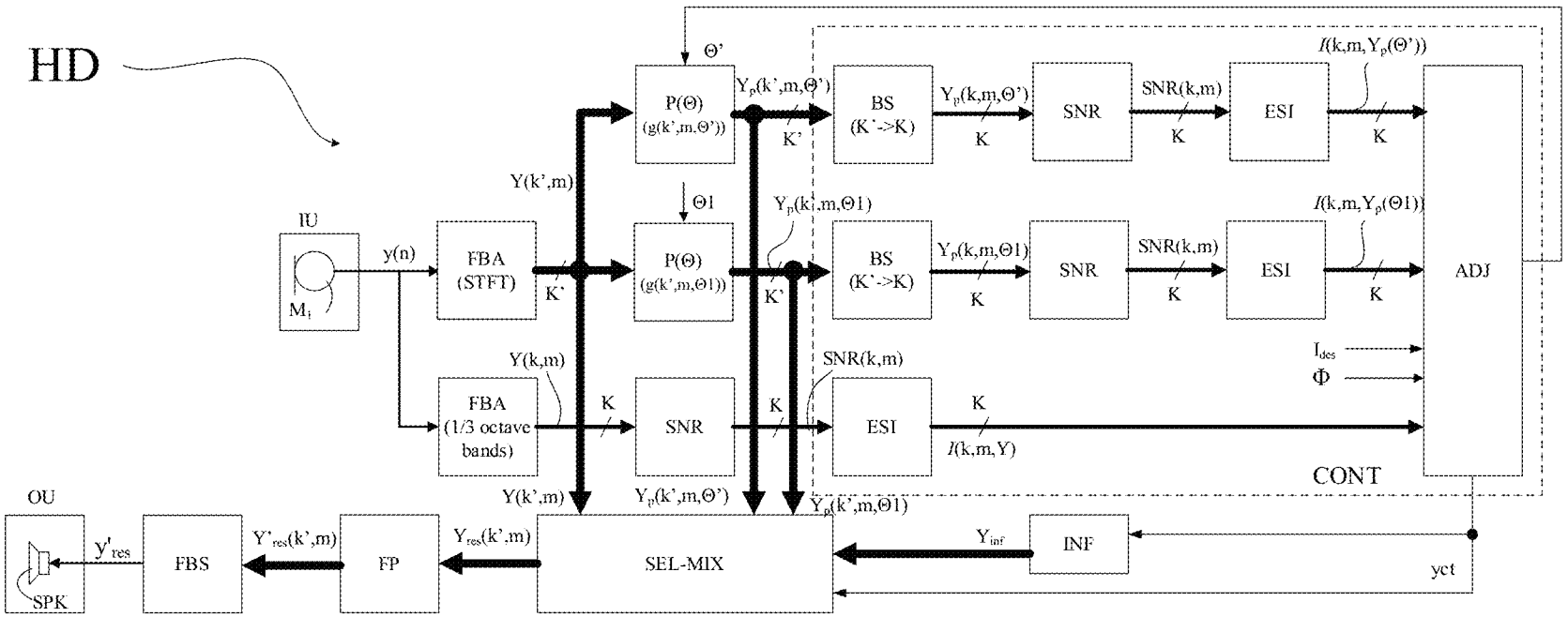
FIG. 4B shows a block diagram of a second embodiment of a hearing aid illustrating the use of 'dual resolution' in the time-frequency processing of signals of the hearing aid according to the present disclosure.

FIG. 4B shows a block diagram of a second embodiment of a hearing device, e.g. a hearing aid, illustrating the use of 'dual resolution' in the time-frequency processing of signals of the hearing aid according to the present disclosure. The embodiment of FIG. 4B is similar to the embodiment of FIG. 4A, but further comprises a more specific indication of the estimation of the speech intelligibility measure I using estimates of SNR (cf. units SNR) in a lower frequency resolution k (K frequency bands, here assumed to be in one-third octave frequency bands, to mimic the human auditory system) than the processing algorithms of the forward path.

The additional inputs from internal or external sensors (e.g. speech (voice) activity detectors, and or other, e.g. optical, detectors, or bio-sensors) are not indicated in FIGS. 4A and 4B, but may of course be used to further improve the performance of the hearing device, as e.g. indicated in FIG. 1A.

Figure 5:
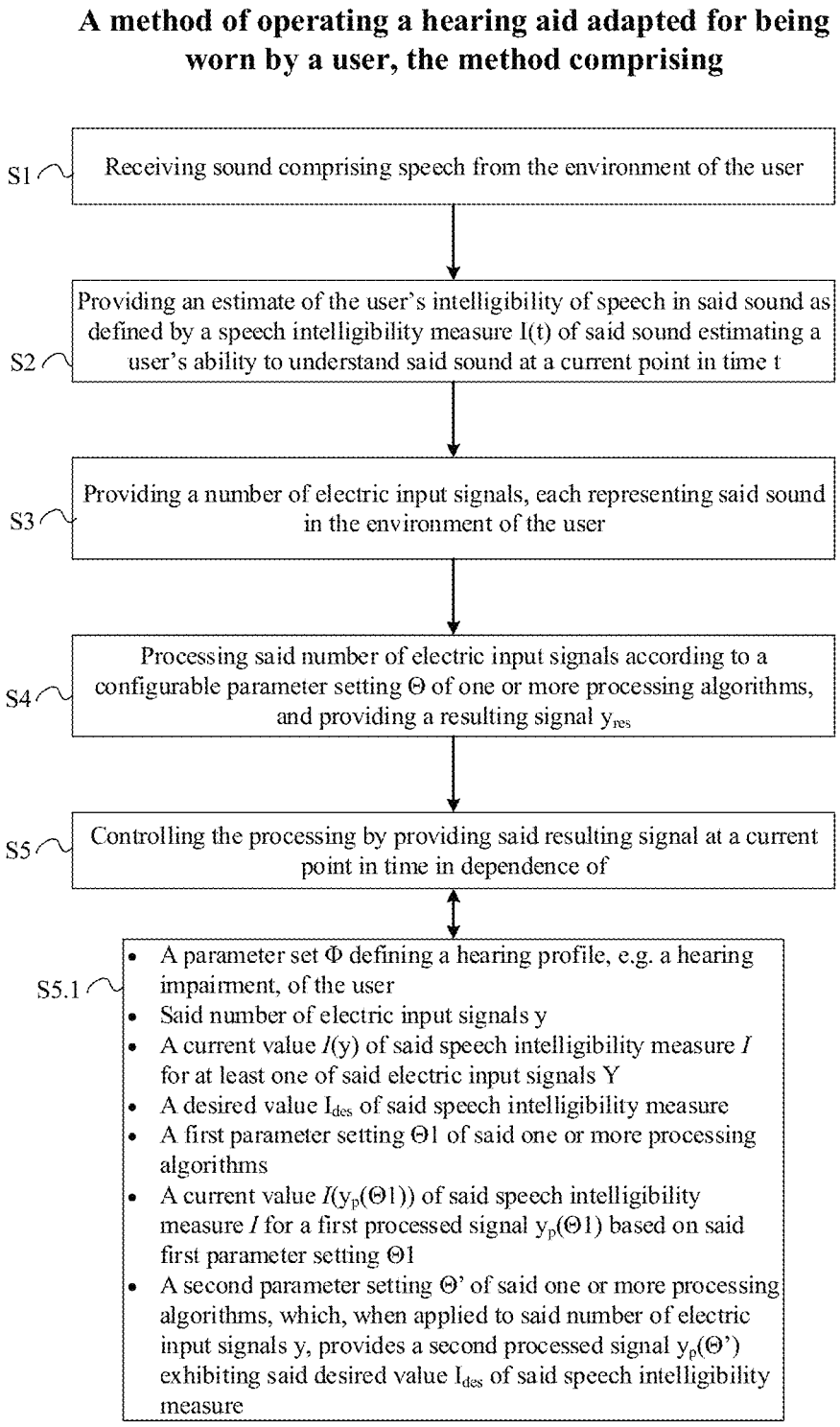
FIG. 5 shows a flow diagram for a method of operating a hearing aid according to a first embodiment of the present disclosure.

FIG. 5 shows a flow diagram for a method of operating a hearing aid according to a first embodiment of the present disclosure. The hearing aid is adapted for being worn by a user. The method comprises S1. receiving sound comprising speech from the environment of the user;

S2. providing a speech intelligibility measure I for estimating a user's ability to understand speech in said sound at a current point in time t;

S3. providing a number of electric input signals, each representing said sound in the environment of the user;

S4. processing said number of electric input signals according to a configurable parameter setting Θ of one or more processing algorithms, and providing a resulting signal $y_{res}$ S5. controlling the processing by providing said resulting signal $y_{res}$ at a current point in time t in dependence of
- a parameter set Φ defining a hearing profile of the user, said number of electric input signals y,
- a current value I(y) of said speech intelligibility measure I for at least one of said electric input signals y,
- a desired value $I_{des}$ of said speech intelligibility measure, and
- a first parameter setting Θ1 of said one or more processing algorithms, and
- a current value $I(y_p(\Theta 1))$ of said speech intelligibility measure I for a first processed signal $y_p(\Theta 1)$ based on said first parameter setting Θ1, and
- a second parameter setting Θ' of said one or more processing algorithms, which, when applied to said number of electric input signals y, provides a second processed signal $y_p(\Theta')$ exhibiting said desired value $I_{des}$ of said speech intelligibility measure.

Figure 6:
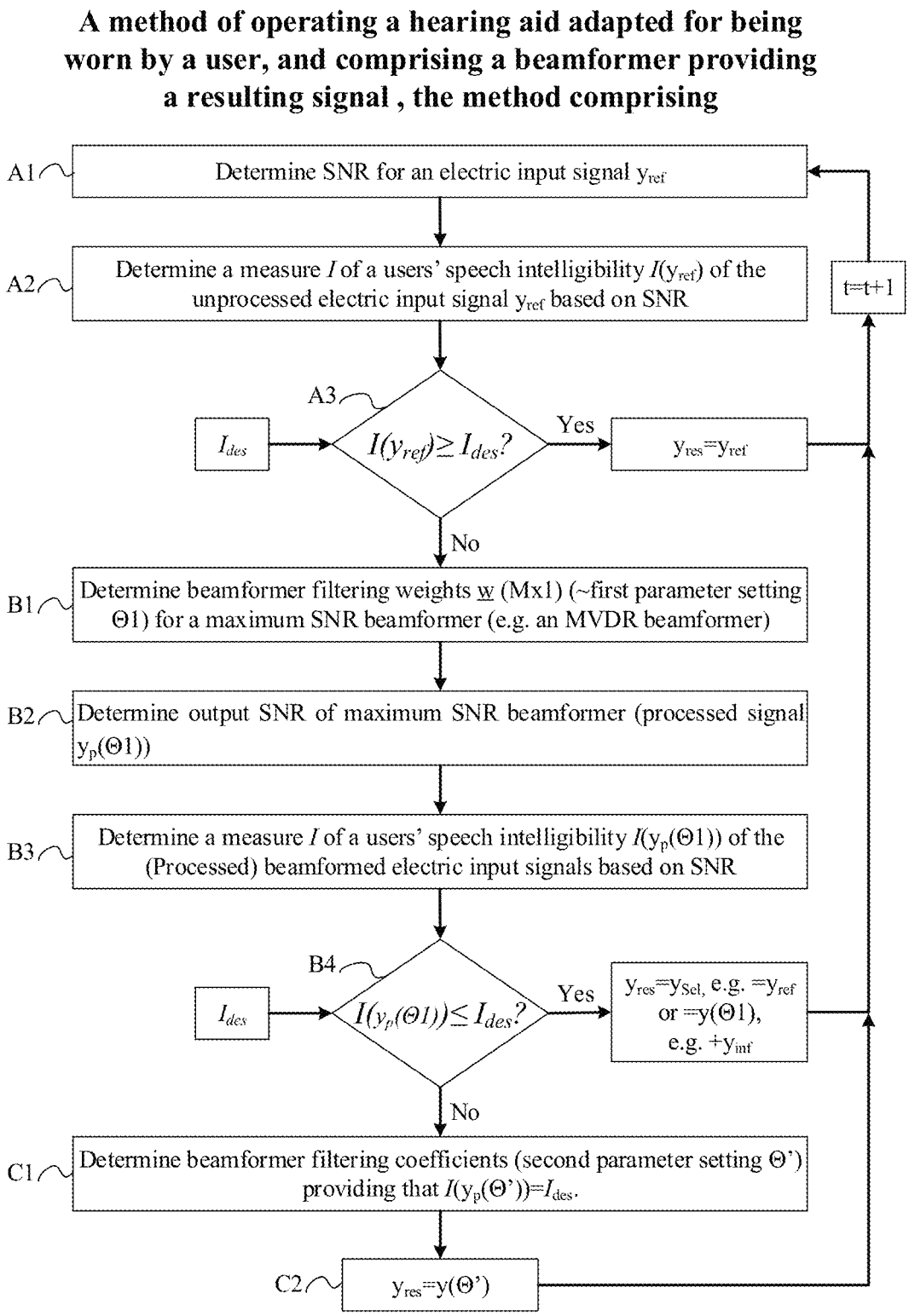
FIG. 6 shows a flow diagram for a method of operating a hearing aid according to a second embodiment of the present disclosure, and FIG. 7A schematically shows a conceptual block diagram of a hearing aid comprising a noise reduction and hearing loss compensation system comprising a multitude of individually selectable beamformer-postfilter pairs according to an embodiment of the present disclosure, and FIG. 7B schematically shows a block diagram of hearing aid comprising a noise reduction and hearing loss compensation system with a single configurable beamformer-postfilter pair according to an embodiment of the present disclosure.

FIG. 6 shows a flow diagram for a method of operating a hearing aid according to a second embodiment of the present disclosure. FIG. 6 shows a flow diagram for a method of operating a hearing aid comprising a multi-input beamformer and providing a resulting signal $y_{res}$ according to an embodiment of the present disclosure. The method comprises—at a given point in time t the following processes A1. Determine SNR for an electric input signal $y_{ref}$ received at a reference microphone;

A2. Determine a measure I of a users' speech intelligibility $I(y_{ref})$ of the unprocessed electric input signal $y_{ref}$;

A3. If $I(y_{ref})>I_{des}$, where $I_{des}$ is a desired value of the speech intelligibility measure I, set $y_{res}=y_{ref}$, and don't apply the processing algorithm;

otherwise

B1. Determine beamformer filtering weights $\underline{w}$ (M×1) (first parameter setting Θ1) for a maximum SNR beamformer (e.g. an MVDR beamformer):

$$\underline{w} = \frac{\overline{\overline{C}}_V^{-1}\,\underline{d}}{\underline{d}^H\,\overline{\overline{C}}_V^{-1}\,\underline{d}}$$

Where $\overline{C}_v$ is the (M×M) noise covariance matrix of the noisy input signals $\underline{Y}$, and $\underline{d}$ is the (M×1) look vector. (The look vector may be determined in advance, or be adaptively determined, cf. e.g. [9]))

(A beamformed signal (processed signal $y_p(\underline{\Theta 1})=y_p(\underline{w})$), representing an estimate $\hat{S}(1\times 1)$ of the target (speech) signal S of current interest to the user may then be determined by $\hat{S}=\underline{w}^H\,\underline{Y}$, where $\underline{Y}$ is the noisy input signal (M×1). The expression for the (maximum SNR) estimate $\hat{S}$ of the target signal may e.g. be provided in a time-frequency representation, i.e. a value of $\hat{S}$ for each time frequency tile (k',m)).

B2. Determine output SNR of maximum SNR beamformer (processed signal $y_p(\Theta 1)$)

$$\max\text{-}\widehat{SNR}=f(\overline{C}_Y,\overline{C}_v,\underline{w})$$

Where $\overline{C}_Y$ is the (M×M) covariance matrix of the noisy input signals $\underline{Y}$, and where f(•) represents a functional relationship.

B3. Determine an estimated speech intelligibility $$I_{max\text{-}SNR}=f'(\max\text{-}\widehat{SNR})$$

Where f'(•) represents a functional relationship.

B4. If $I_{max\text{-}SNR}(=I(y_p(\Theta 1))\leq I_{des}$ (path 'Yes' in FIG. 6), where $I_{des}$ is the desired value of the speech intelligibility measure I, set $y_{res}=y_{sel}$, where $y_{sel}$ is a selectable signal e.g. equal to an unprocessed input signal $y_{ref}$ or to the first processed signal $y_{res}=y_p(\Theta 1)$, or to a combination of one of them with an information signal $y_{inf}$ indicating that the intelligibility situation is difficult.

C1. If $I_{max\text{-}SNR}$ $(=(y_p(\Theta 1))\geq I_{des}$ (path 'No' in FIG. 6), determine beamformer filtering coefficients (second parameter setting Θ', filter weights $\underline{w}$) providing that $I(y_p(\Theta'))=I_{des}$. The second parameter setting Θ' may be determined by a variety of methods, e.g. an exhaustive search among the possible values, and/or with further constraints, e.g. using statistical methods, e.g. utilizing the I is a monotonous function of SNR.

C2. Set $y_{res}=y_p(\Theta')$.

Preferably, the parameter setting Θ' (k',m) is determined in a finer frequency resolution k' than the speech intelligibility measure I(k,m).

Example, Noise Reduction Control Based on an Estimate of Speech Intelligibility:

In an aspect of the present disclosure, wherein the speech intelligibility measure is based on predictability. Highly predictable parts of an audio signal carry less information than parts of the audio signal with a lower predictability. One way to estimate intelligibility based on predictability is to weight frames in time and frequency higher, if the frames are less predictable from the surrounding frames.

Figure 7A:
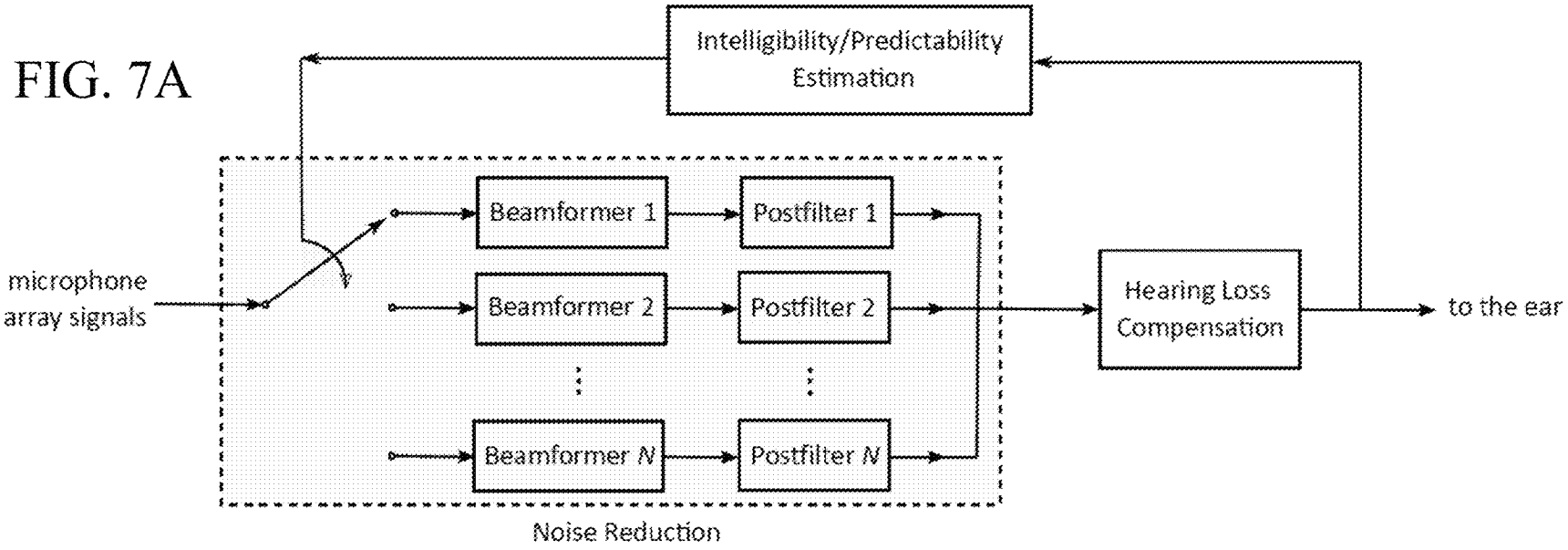

A conceptual block diagram of the proposed joint design is shown in FIG. 7A. A typical noise reduction system in existing hearing aids may be composed of a (multi-microphone) beamformer and a (single-channel) postfilter (see e.g. EP2701145A1). In comparison, the proposed noise reduction system (cf. dashed rectangular enclosure denoted 'Noise Reduction' in FIG. 7A) is composed of several (pairs of) beamformers and postfilters with different levels of directionality and aggression (cf. (Beamformer 1, Postfilter 1), (Beamformer 2, Postfilter 2), . . . , (Beamformer N, Postfilter N) in FIG. 7A.

At any given time, only one beamformer-postfilter pair is connected to the electric input signals in the circuit (cf. 'microphone array signals' connected to (Beamformer 1, Postfilter 1 via switch in FIG. 7A). For a given speech frame, the speech intelligibility (SI) is estimated using an SI-estimator or a predictability-based measure (cf. block 'Intelligibility/Predictability Estimation' in FIG. 7A). Next, the estimated SI/predictability level is used to determine which beamformer-postfilter pair should be applied (by controlling the switch in FIG. 7A). For instance, frames with high SI do not require much processing, and thus a very mild (less aggressive) beamformer-postfilter pair will be chosen in such cases. Opposite, frames with low SI require more processing, and a more aggressive beamformer-postfilter pair should be chosen. The spatially filtered and noise reduced signal out of the Noise Reduction-block is fed to a processor for applying a frequency and level dependent gain (or attenuation) to the noise reduced signal, e.g. to compensate for a hearing impairment of a user of the hearing aid (cf. block denoted 'Hearing Loss Compensation' in FIG. 7A). The output of the processor is fed to an output unit for presentation to the user as stimuli perceivable as sound (cf. 'to the ear' in FIG. 7A). The output of the processor is further fed to the block 'Intelligibility/Predictability Estimation' allowing an estimation of the user's intelligibility of the sound presented to the user, and to provide a control signal indicative of appropriate parameters of the beamformer-postfilter unit.

Figure 7B:
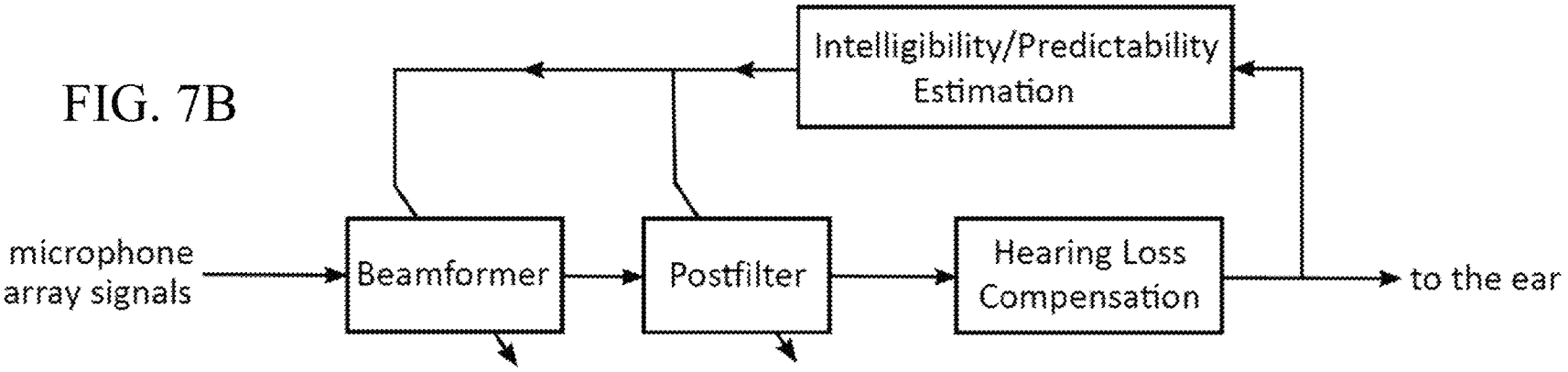

In practice, it may not be desirable to implement several beamformers and postfilters in hardware. A more practical block diagram that encompasses the above idea is shown in FIG. 7B. Here, there is only one beamformer and one postfilter with a set of adjustable parameters (otherwise, the configuration is as shown in and described in connection with FIG. 7A). As e.g. discussed in US20170295437A1, by tuning these parameters, one can achieve various levels of aggression and directionality, equivalent to the various beamformer-postfilter pairs in FIG. 7A. However, this is a more general approach, since the adjustable parameters take continuous values and possibilities are infinite, as opposed to the limited set of choices in FIG. 7A.

The avoid unpleasant artifacts during switching from one beamformer-postfilter pair to another (FIG. 7A) or from one set of adjustable parameters to another (FIG. 7B) the hearing aid may be configured to fade between the two sets of beamformer-postfilter pairs or parameter sets (and/or having a certain hysteresis built into the shifts).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[1] S. Gannot, D. Burshtein, and E. Weinstein, "Signal enhancement using beamforming and nonstationarity with applications to speech," IEEE Trans. Signal Processing, vol. 49, no. 8, pp. 1614-1426, August 2001.

[2] C. H. Taal, J. Jensen and A. Leijon, "On Optimal Linear Filtering of Speech for Near-End Listening Enhancement," IEEE Signal Processing Letters, Vol. 20, No. 3, pp. 225-228, March 2013.

[3] R. C. Hendriks, J. B. Crespo, J. Jensen, and C. H. Taal, "Optimal Near-End Speech Intelligibility Improvement Incorporating Additive Noise and Late Reverberation Under an Approximation of the Short-Time SII," IEEE Trans. Audio, Speech, Language Process., Vol. 23, No. 5, pp. 851-862, 2015.

[4] S. Boyd and L. Vandenberghe, "Convex Optimization," Cambridge University Press, 2004.

[5] "American National Standard Methods for the Calculation of the Speech Intelligibility Index," ANSI S3.5-1997, Amer. Nat. Stand. Inst.

[6] J. Jensen and M. S. Pedersen, "Analysis of Beamformer Directed Single-Channel Noise Reduction System for Hearing Aid Applications," Proc. Int. Conf. Acoust., Speech, Signal Processing, pp. 5728-5732, April 2015.

[7] EP3057335A1 (Oticon) 17 Aug. 2016

[8] US20050141737A1 (Widex) 30 Jun. 2005

[9] EP2701145A1 (Oticon) 26 Feb. 2014

[10] Koenraad S. Rhebergen, Niek J. Versfeld, Wouter. A. Dreschler), and, Extended speech intelligibility index for the prediction of the speech reception threshold in fluctuating noise, The Journal of the Acoustical Society of America, Vol. 120, pp. 3988-3997 (2006)

[11] Cees H. Taal; Richard C. Hendriks; Richard Heusdens; Jesper Jensen, A short-time objective intelligibility measure for time-frequency weighted noisy speech, Acoustics Speech and Signal Processing (ICASSP), 2010 IEEE International Conference on

[12] US20170295437A1 (Oticon) Dec. 10, 2017

The invention claimed is:

1. A hearing device adapted for being worn by a user and for receiving sound from the environment of the user and to process the sound with a view to the user's intelligibility of speech in said sound, an estimate of the user's intelligibility of speech in said sound being defined by a speech intelligibility measure I of said sound at a current point in time t, the hearing device comprising:

an input unit for providing a number of electric input signals y, each representing said sound in the environment of the user;

an signal processor for processing said number of electric input signals y according to a configurable parameter setting Θ of one or more processing algorithms, which when applied to said number of electric input signals y provides a processed signal $y_p(\Theta)$ in dependence thereof, the signal processor being configured to provide a resulting signal $y_{res}$; and a controller configured to control the processor to provide said resulting signal $y_{res}$ at a current point in time t in dependence of a parameter set Φ defining a hearing profile of the user, said electric input signal(s) y or characteristics extracted from said electric input signal(s), a current value I(y) of said speech intelligibility measure I for at least one of said electric input signals y, a desired value $I_{des}$ of said speech intelligibility measure, and a first parameter setting Θ1 of said one or more processing algorithms, and a current value $I(y_p(\Theta))$ of said speech intelligibility measure I for a first processed signal $y_p(\Theta 1)$ based on said first parameter setting Θ1, and a second parameter setting Θ' of said one or more processing algorithms, which, when applied to said number of electric input signals y, provides a second processed signal $y_p(\Theta')$ exhibiting said desired value $I_{des}$ of said speech intelligibility measure.

2. A hearing device according to claim 1, wherein said controller is configured to control the processor to provide that said resulting signal $y_{res}$ at a current point in time t is equal to one of said number of electric input signals y, in case said current value I(y) of said speech intelligibility measure I for said one of said number of electric input signals y is larger than or equal to said desired value $I_{des}$ of said speech intelligibility measure.

3. A hearing device according to claim 1, wherein said controller is configured to provide that said resulting signal $y_{res}$ at a current point in time t is equal to a selectable signal $y_{sel}$, in case said current values I(y) and $I(y_p(\Theta))$ of said speech intelligibility measure I for said number of electric input signals y and said first processed signal $y_p(\Theta 1)$, respectively, are both smaller than said desired value $I_{des}$.

4. A hearing device according to claim 1, wherein said controller is configured to control the processor to provide that said resulting signal $y_{res}$ at a current point in time t is equal to said second, optimized, processed signal $y_p(\Theta')$ exhibiting said desired value $I_{des}$ of said speech intelligibility measure, in case said current value $I(y_p(\Theta 1))$ of said speech intelligibility measure I for said first processed signal $y_p(\Theta 1)$ is larger than said desired value $I_{des}$ of said speech intelligibility measure.

5. A hearing device according to claim 1, wherein the first parameter setting Θ1 is a setting that maximizes a signal to noise ratio (SNR) or the speech intelligibility measure I of the first processed signal $y_p(\Theta 1)$.

6. A hearing device according to claim 1, where the one or more processing algorithms comprises a single channel noise reduction algorithm.

7. A hearing device according to claim 1 wherein the input unit is configured to provide a multitude of electric input signals $y_i$, i=1, . . . , M, each representing said sound in the environment of the user, and where the one or more processing algorithms comprises a beamformer algorithm for receiving said multitude of electric input signals, or processed versions thereof, and providing a spatially filtered, beamformed, signal, the beamformer algorithm being controlled by beamformer settings, and where said first parameter setting Θ1 of said one or more processing algorithms comprise a first beamformer setting, and where said second parameter setting Θ' of said one or more processing algorithms comprises a second beamformer setting.

8. A hearing device according to claim 1 wherein the input unit is configured to provide said number of electric input signals in a time-frequency representation $Y_r(k,m)$, r=1, . . . , M, where M is the number of electric input signals, k is frequency index, and m is a time index.

9. A hearing device according to claim 1 wherein the hearing device is configured to receive further electric input signals from a number of sensors, and to influence said control of the processor in dependence thereof.

10. A hearing device according to claim 1 wherein said speech intelligibility measure I is a measure of a target signal to noise ratio, where the target signal represents a signal containing speech that the user currently intends to listen to, and the noise represents all other sound components in said sound in the environment of the user.

11. A hearing device according to claim 1 adapted to a user's hearing profile, e.g. to compensate for a hearing impairment of the user, the hearing profile of the user being defined by a parameter set Φ.

12. A hearing device according to claim 11 wherein one of said 'one or more processing algorithms', is configured to compensate for a hearing loss of the user.

13. A hearing device according to claim 1 wherein said controller is configured to determine said estimate of the speech intelligibility measure I for use in determining said second, optimized, parameter setting $\Theta'(k',m)$ with a second frequency resolution k that is lower than a first frequency resolution k' that is used to determine said first parameter setting $\Theta1(k',m)$ on which said first processed signal is based.

14. A hearing device according to claim 1 constituting or comprising a hearing aid.

15. A method of operating a hearing device adapted for being worn by a user and to process sound with a view to the user's intelligibility of speech in sound, the method comprising:

receiving sound comprising speech from the environment of the user;

providing a speech intelligibility measure I for estimating a user's ability to understand speech in said sound at a current point in time t;

providing a number of electric input signals, each representing said sound in the environment of the user;

processing said number of electric input signals according to a configurable parameter setting $\Theta$ of one or more processing algorithms, and providing a resulting signal $y_{res}$; and controlling the processing by providing said resulting signal $y_{res}$ at a current point in time t in dependence of a parameter set $\Phi$ defining a hearing profile of the user, said number of electric input signals y, or characteristics extracted from said electric input signal(s), a current value I(y) of said speech intelligibility measure I for at least one of said electric input signals y, a desired value $I_{des}$ of said speech intelligibility measure, and a first parameter setting $\Theta1$ of said one or more processing algorithms, and a current value $I(y_p(\Theta1))$ of said speech intelligibility measure I for a first processed signal $y_p(\Theta1)$ based on said first parameter setting $\Theta1$, and a second parameter setting $\Theta'$ of said one or more processing algorithms, which, when applied to said number of electric input signals y, provides a second processed signal $y_p(\Theta')$ exhibiting said desired value $I_{des}$ of said speech intelligibility measure.

16. A method according to claim 15, wherein the first parameter setting $\Theta1$ is a setting that maximizes a signal to noise ratio (SNR) and/or a said speech intelligibility measure I of the first processed signal $y_p(\Theta1)$.

17. A method according to claim 15 wherein providing said resulting signal $y_{res}$ at a current point in time t comprises setting $y_{res}$ equal to one of said electric input signals y in case that a current value I(y) of said speech intelligibility measure I for said one of said electric input signals y is larger than or equal to said desired value $I_{des}$; and in case that a current value I(y) of said speech intelligibility measure I for said electric input signals y is smaller than the desired value $I_{des}$, and that a current value $I(y_p(\Theta1))$ of the first processed signal is larger than the desired value $I_{des}$ of the speech intelligibility measure I, determining said second parameter setting $\Theta'$ under the constraint that the second processed signal $y_p(\Theta')$ exhibits the desired value $I_{des}$ of the speech intelligibility measure;

setting $y_{res}$ equal to said second processed signal $y_p(\Theta')$.

18. A hearing device adapted for being worn by a user and for receiving sound from the environment of the user and to process the sound with a view to the user's intelligibility of speech in said sound, an estimate of the user's intelligibility of speech in said sound being defined by a speech intelligibility measure I of said sound at a current point in time t, the hearing device comprising an input unit for providing a number of electric input signals y, each representing said sound in the environment of the user;

a signal processor for processing said number of electric input signals y according to a configurable parameter setting $\Theta$ of one or more processing algorithms, which when applied to said number of electric input signals y provides a processed signal $y_p(\Theta)$ in dependence thereof, the signal processor being configured to provide a resulting signal $y_{res}$;

a memory wherein a desired value $I_{des}$ of said speech intelligibility measure is stored; and a controller configured to control the processor to provide said resulting signal $y_{res}$ at a current point in time t according to the following scheme in case that a current value I(y) of said speech intelligibility measure I for said number of electric input signals y is smaller than the desired value $I_{des}$, and that a current value $I(y_p(\Theta1))$ of a first processed signal $y_p(\Theta1)$ for a first parameter setting $\Theta1$ of said one or more processing algorithms is larger than the desired value $I_{des}$ of the speech intelligibility measure I, determining a second parameter setting $\Theta'$ under the constraint that the second processed signal $y_p(\Theta')$ exhibits the desired value $I_{des}$ of the speech intelligibility measure and setting said resulting signal $y_{res}$ equal to said second processed signal $y_p(\Theta')$.

19. A hearing device according to claim 17 wherein said controller is further configured to control the processor to provide said resulting signal $y_{res}$ at a current point in time t according to the following scheme in case that a current value I(y) of said speech intelligibility measure I for said one of said electric input signals y is larger than or equal to said desired value $I_{des}$, setting said resulting signal $y_{res}$ equal to one of said electric input signals y; and in case that current values I(y) and $I(y_p(\Theta1))$ of said speech intelligibility measure I for said number of electric input signals y and for a first processed signal $y_p(\Theta1)$ for a first parameter setting $\Theta1$ of said one or more processing algorithms, respectively, are both smaller than said desired value $I_{des}$, setting said resulting signal $y_{res}$ equal to a selectable signal $y_{sel}$.

20. A hearing device according to claim 18, wherein said first parameter setting $\Theta1$ is a setting that maximizes a signal to noise ratio (SNR) or the speech intelligibility measure I of the first processed signal $y_p(\Theta1)$.

21. A hearing device comprising a processor for applying one or more processing algorithms to an electric input signal y representing sound, a speech intelligibility estimator providing an estimate I of a user's intelligibility of said sound at a current time m from said electric input signal y(m), a predictor of a current value, e.g. a current time frame, of the electric input signal y(m) from previous values of the input signal y(m−1), . . . , y(m−N), e.g. N previous time frames, of the electric input signal, a controller configured to control the speech intelligibility estimator in dependence of the estimated predictability of the sound signal, to thereby provide a modified speech intelligibility estimate.

22. A hearing device according to claim 21 wherein the controller is configured to apply a higher weight to the speech intelligibility estimator the lower the estimated predictability of the sound signal, to thereby provide the modified speech intelligibility estimate.

23. A hearing device according to claim 21 configured to control said one or more processing algorithms, in dependence of said modified speech intelligibility estimate.

* * * * *